US011008657B2

(12) United States Patent
Kim et al.

(10) Patent No.: US 11,008,657 B2
(45) Date of Patent: May 18, 2021

(54) COMPOSITION FOR CATALYST-FREE ELECTROLESS PLATING AND METHOD FOR ELECTROLESS PLATING USING THE SAME

(71) Applicant: Korea Institute of Machinery & Materials, Daejeon (KR)

(72) Inventors: Taehoon Kim, Changwon-si (KR); Sang Bok Lee, Changwon-si (KR); Byung Mun Jung, Seoul-si (KR); Kyunbae Lee, Daejeon-si (KR)

(73) Assignee: Korea Institute of Materials Science, Gyeongsangnam-do (KR)

( * ) Notice: Subject to any disclaimer, the term of this patent is extended or adjusted under 35 U.S.C. 154(b) by 0 days.

(21) Appl. No.: 16/233,563

(22) Filed: Dec. 27, 2018

(65) Prior Publication Data

US 2019/0256981 A1 Aug. 22, 2019

(30) Foreign Application Priority Data

Feb. 20, 2018 (KR) ..... 10-2018-0019793

(51) Int. Cl.
*C23C 18/34* (2006.01)

(52) U.S. Cl.
CPC ..... *C23C 18/34* (2013.01)

(58) Field of Classification Search
CPC . C23C 18/16; C23C 18/1601; C23C 18/1633; C23C 18/1639; C23C 18/1641; C23C 18/1642; C23C 18/1644; C23C 18/1662; C23C 18/32; C23C 18/34; C23C 18/36; C23C 18/48; C23C 18/50
USPC ..... 427/304, 305, 306, 437, 438, 443.1
See application file for complete search history.

(56) References Cited

U.S. PATENT DOCUMENTS 4,328,266 A * 5/1982 Feldstein ..... C23C 18/28 106/1.11
4,484,988 A * 11/1984 Robinson ..... C23C 18/32 205/187
2005/0227073 A1* 10/2005 Oyamada ..... B22F 1/025 428/403
2015/0110965 A1* 4/2015 Brunner ..... C23C 18/34 427/430.1

FOREIGN PATENT DOCUMENTS

JP 7065181 B2 9/1987
JP 62205287 A * 9/1987 ..... C23C 18/34
JP 2011231382 A 11/2011
KR 10-2014-0091548 A 7/2014

OTHER PUBLICATIONS

Office Action dated May 8, 2018, issued in corresponding Korean Patent Application No. 10-2018-0019793.

* cited by examiner

*Primary Examiner* — Dah-Wei D. Yuan
*Assistant Examiner* — Nga Leung V Law
(74) *Attorney, Agent, or Firm* — Harness, Dickey & Pierce, P.L.C.

(57) ABSTRACT

This disclosure relates to a composition for catalyst-free electroless plating and a method for catalyst-free electroless plating using the same. More particularly, this disclosure relates to a composition for catalyst-free electroless plating and a method for catalyst-free electroless plating using the same that does not require a catalyst such as an expensive noble metal catalyst and may simplify the process.

11 Claims, 21 Drawing Sheets
(17 of 21 Drawing Sheet(s) Filed in Color)

COMPOSITION FOR CATALYST-FREE ELECTROLESS PLATING AND METHOD FOR ELECTROLESS PLATING USING THE SAME

CROSS REFERENCE TO RELATED APPLICATION(S)

This application claims the benefit of Korean Patent Application No. 10-2018-0019793 filed on Feb. 20, 2018 in the Korean Intellectual Property Office, the entire disclosure of which is incorporated herein by for all purposes.

BACKGROUND

1. Field

This disclosure relates to a composition for catalyst-free electroless plating and a method for electroless plating using the same. More particularly, this disclosure relates to a composition and a method for catalyst-free electroless plating using the same that does not require a catalyst such as an expensive noble metal catalyst and simplifies the process.

2. Description of Related Art

Electroless plating involves deposition of metals on the surface of a material to be plated by auto-catalytically reducing metal ions in an aqueous metal salt solution with a reducing agent without the use of external electrical power. Electroless plating is also known as chemical or auto-catalytic plating. A reducing agent such as formaldehyde or hydrazine in an aqueous solution supplies electrons such that the metal ions are reduced to the metal molecule, which occurs at the surface of the catalyst. The most commercially available plating agents are copper, a nickel-phosphorus alloy, and a nickel-boron alloy. Compared to electroplating, the plating layer is dense, has a uniform thickness of about 25 μm, and may be applied not only to conductors but also to various substrates such as plastics and organisms.

The electroless plating generally consists of three steps: sensitization, activation, and plating. The sensitization step involves immersing a material to be plated into a mixed solution of an aqueous $SnCl_2$ solution and hydrochloric acid, which is to reduce the noble metal catalyst on the material to be plated. The activation step involves immersing the material to be plated into a $PdCl_2$/KCl solution to deposit Pd, which is a catalyst for plating, on the material to be plated. The plating step involves immersing the activated material to be plated into a FeCoNi plating bath.

The conventional electroless plating method requires an expensive noble metal catalyst such as Pd or Pt, which increases manufacturing cost. In addition, the process is complicated due to the necessity of catalyst pretreatment steps such as sensitization and activation.

In Korean Patent Publication No. 10-2014-0091548, an electroless palladium plating bath composition is disclosed.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A material of this disclosure is to provide a composition for catalyst-free electroless plating which does not require a catalyst such as an expensive noble metal catalyst and is able to simplify a manufacturing process.

Another material of this disclosure is to provide a method for catalyst-free electroless plating which is able to simplify a manufacturing process and reduce a manufacturing cost without the need for a catalyst.

According to an aspect, there is provided a composition for catalyst-free electroless plating including a metal precursor including a nickel precursor; a reducing agent; a material to be plated; and a dispersion medium, wherein a concentration of the metal precursor is 0.0001 to 0.07 M.

According to one embodiment, pH of composition for catalyst-free electroless plating may be at least 6.5.

According to one embodiment, the material to be plated in the composition for catalyst-free electroless plating may be graphene, carbon nanotube, carbon black, carbon fiber, glass fiber, polymer fiber, or porous carbon material.

According to one embodiment, the nickel precursor in the composition for catalyst-free electroless plating may be at least one selected from nickel acetate, nickel sulfate($NiSO_4$), nickel chloride($NiCl_2$), nickel carbonate($NiCO_3$), nickel nitrate($Ni(NO_3)_2$), and a hydrate thereof.

According to an embodiment, the metal precursor in the composition for catalyst-free electroless plating may further include at least one selected from an iron precursor, a cobalt precursor, a copper precursor, a molybdenum precursor, a tungsten precursor, and a zinc precursor.

According to one embodiment, the nickel of the nickel precursor in the composition for catalyst-free electroless plating may be contained at an atomic ratio of 2% or more with respect to the entire metal of the metal precursor.

According to one embodiment, the reducing agent in the composition for catalyst-free electroless plating may include at least one selected from dimethylamine borane (DMAB), hydrazine, sodium hypophosphite, sodium borohydride, and formaldehyde.

According to one embodiment, a temperature of the composition for catalyst-free electroless plating may be at least 75° C.

According to another aspect, there is provided a method for catalyst-free electroless plating including: i) preparing a composition for electroless plating comprising a metal precursor comprising a nickel precursor and a reducing agent; and ii) introducing the composition for electroless plating into a dispersion solution containing a material to be plated so that a concentration of the metal precursor is 0.0001-0.07 M.

According to one embodiment, the step i) of the method for catalyst-free electroless plating may further include controlling pH of the composition for electroless plating to at least 6.5.

According to one embodiment, the step i) of the method for catalyst-free electroless plating may further include heating the composition for electroless plating to 75° C. or higher.

According to one embodiment, the step ii) of the method for catalyst-free electroless plating may be maintained for at least one minute to promote nuclear growth.

According to one embodiment, the step ii) of the method for catalyst-free electroless plating may further include controlling the pH of the dispersion solution containing the material to be plated to at least 6.5.

According to one embodiment, the nickel precursor in the method for catalyst-free electroless plating may be at least one selected from nickel acetate, nickel sulfate($NiSO_4$), nickel chloride($NiCl_2$), nickel carbonate($NiCO_3$), nickel nitrate($Ni(NO_3)_2$), and a hydrate thereof.

According to one embodiment, the metal precursor in the method for catalyst-free electroless plating may further include at least one selected from an iron precursor, a cobalt precursor, a copper precursor, a molybdenum precursor, a tungsten precursor, and a zinc precursor.

According to one embodiment, the nickel of the nickel precursor in the method for catalyst-free electroless plating may be included at an atomic ratio of 2% or more with respect to the entire metal of the metal precursor.

According to one embodiment, the reducing agent in the method for catalyst-free electroless plating may include at least one selected from dimethylamine borane (DMAB), hydrazine, sodium hypophosphite, sodium borohydride, and formaldehyde.

According to one embodiment, the material to be plated in the method for catalyst-free electroless plating may be graphene, carbon nanotube, carbon black, carbon fiber, glass fiber, polymer fiber, or porous carbon material.

According to one embodiment of this disclosure, it allows catalyst-free electroless plating in a single step without any catalyst pretreatment step since no catalyst is required.

According to an embodiment of this disclosure, there is no need for a catalyst such as an expensive noble metal catalyst, and the manufacturing cost of the electroless plating may be reduced by simplifying a manufacturing process.

Other materials and advantages of this disclosure will become more apparent from the following detailed description of the invention, claims and drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fees.

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
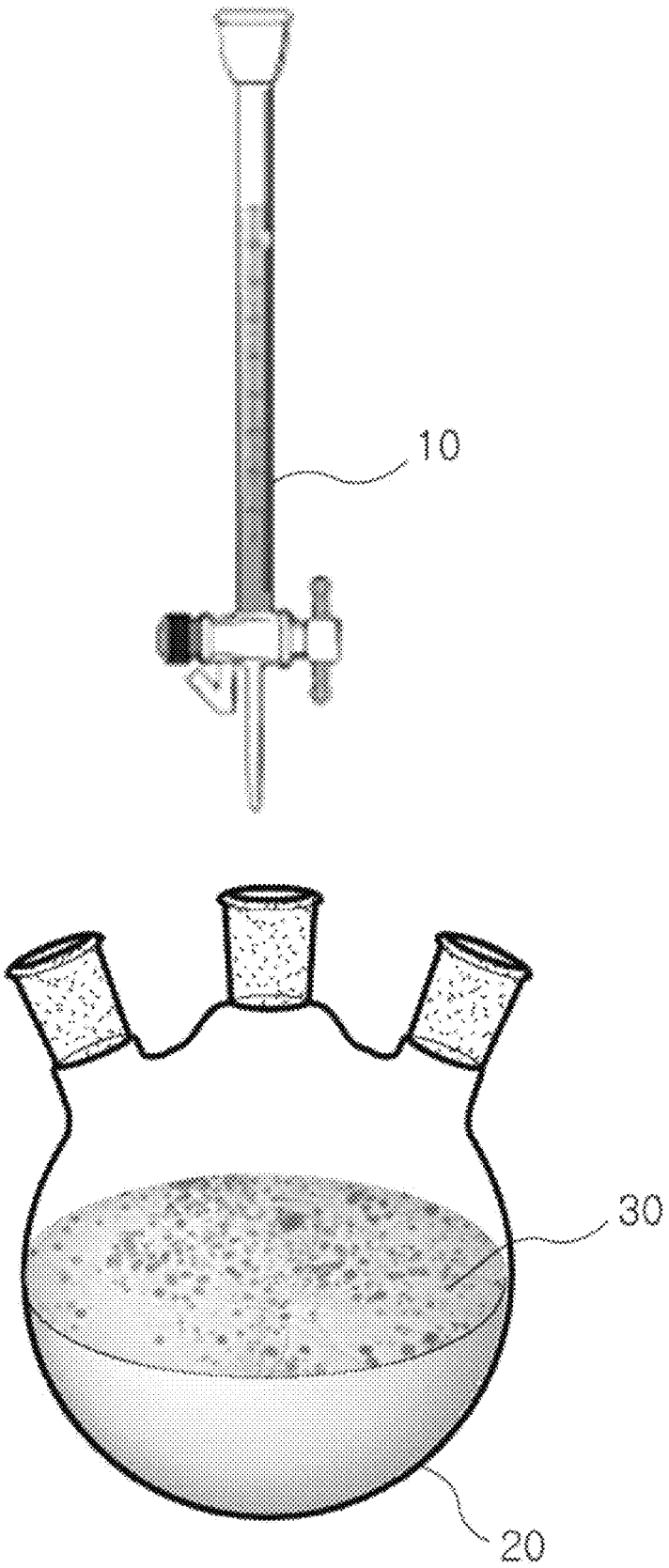
FIG. 1 is a schematic view illustrating an example of a method for catalyst-free electroless plating.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there may be no other elements intervening therebetween.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

In the present description, an expression such as "comprising" or "consisting of" is intended to designate a characteristic, a number, a step, an operation, an element, a part or combinations thereof, and shall not be construed to preclude any presence or possibility of one or more other characteristics, numbers, steps, operations, elements, parts or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

In this disclosure, the composition for electroless plating means a composition including a metal precursor and a reducing agent, but does not include a dispersion solution of a material to be plated.

In this disclosure, the composition for catalyst-free electroless plating means a composition including a composition for electroless plating and a dispersion solution of a material to be plated and is capable of electroless plating without any catalyst.

According to an aspect, there is provided a composition for catalyst-free electroless plating including a metal precursor including a nickel precursor; a reducing agent; a material to be plated; and a dispersion medium, wherein a concentration of the metal precursor is 0.0001 to 0.07 M.

This disclosure may promote the growth of metal nuclei on the surface of the material to be plated by keeping the concentration of the metal precursor relatively low in the dispersion solution containing the material to be plated. As a result, the wettability of the metal on the surface of the material to be plated is improved, and the plating may be performed efficiently without any catalyst. Therefore, unlike the conventional electroless plating, electroless plating may be performed on the material to be plated without any catalyst such as a noble metal catalyst. When the composition for catalyst-free electroless plating of this disclosure is used, any pre-treatment of a catalyst, which is required for conventional electroless plating, is not required. Therefore, electroless plating may be performed in a single step. In addition, a catalyst such as an expensive noble metal catalyst is not required, and the manufacturing cost of electroless plating may be thus reduced.

A concentration of the metal precursor in the composition for catalyst-free electroless plating is preferably from 0.0001 to 0.07 M. When the concentration of the metal precursor in the composition for catalyst-free electroless plating is less than 0.0001 M or more than 0.07 M, the electroless plating reaction may not proceed substantially. The concentration of the metal precursor in the composition for catalyst-free electroless plating may be from 0.0001 to 0.07 M, from 0.0001 to 0.06 M, from 0.0001 to 0.05 M, from 0.0001 to 0.036 M, from 0.0001 to 0.014 M, from 0.0001 to 0.01 M, from 0.0001 to 0.006 M, or from 0.0001 to 0.0054 M, preferably from 0.00012 to 0.07 M, from 0.0012 to 0.06 M, from 0.00012 to 0.05 M, from 0.00012 to 0.036 M, from 0.00012 to 0.014 M, from 0.00012 to 0.01 M, from 0.00012 to 0.006 M, or from 0.00012 to 0.0054 M, more preferably from 0.0001 to 0.014 M, still more preferably from 0.0001 to 0.01 M, and the most preferably from 0.00012 to 0.0006 M. The concentration of the metal precursor to the material to be plated may be controlled by adjusting an addition amount of the metal precursor.

According to one embodiment, the pH of the composition for catalyst-free electroless plating may be at least 6.5. The electroless plating reaction may be carried out even though the pH of the composition for catalyst-free electroless plating is not controlled. However, if the pH of the composition for catalyst-free electroless plating is 6.5 or more, the electroless plating reaction may be promoted and the saturation magnetization value of a composite of the material to be plated-magnetic particles may be increased. Although not limited thereto, the pH of the composition for catalyst-free electroless plating may preferably be 7.0 or more, more preferably 7.5 or more, and still more preferably 9.5 or more.

In this disclosure, the material to be plated is not particularly limited as long as the material may be subjected to the electroless plating process. Examples of the material to be plated may include graphene, carbon nanotube, carbon black, carbon fiber, glass fiber, polymer fiber, and porous carbon material. Electroless plating may proceed more efficiently in case of carbon nanotube (CNT) or carbon fiber.

In this disclosure, the polymer fiber is not particularly limited as long as it may be subjected to the electroless plating process. The polymer fiber may be at least one selected from polyethylene (PE), polypropylene (PP), polyvinyl chloride (PVC), acrylonitrile butadiene styrene (ABS), acetal (POM), liquid crystal polymer (LCP), polybutylene terephthalate (PBT), polyethyleneterephthalate (PET), nylon6,6 (PA), epoxy, phenol, polycarbonate (PC), polyester, polyetheretherketone (PEEK), polyether imide (PEI), polyimide (PI), polyphenyleneoxide (PPO), polyphenylenesulfide (PPS), polystyrene (PS), polytetrafluoroethylene (PTFE), polysulfone (PSO), polyethersulfone (PES), polyamideimide (PAI), silicone polymer, and polydimethylsiloxane (PDMS).

In this disclosure, the porous carbon material is a carbon material having fine pores and is conventionally used as a gas separation, purification of contaminated water, and a carrier of a catalyst. The porous carbon material is not particularly limited as long as it may be applied to the electroless plating process.

In this disclosure, the dispersion medium is not particularly limited as long as it is a dispersion medium in which the material to be plated such as graphene may be dispersed or the material to be plated such as carbon fiber or glass fiber may be immersed. The dispersion medium may be preferably water.

In this disclosure, the nickel precursor is not particularly limited as long as it is a compound containing nickel in a molecule. The nickel precursor may be at least one selected from nickel acetate, nickel sulfate ($NiSO_4$), nickel chloride ($NiCl_2$), nickel carbonate ($NiCO_3$), nickel nitrate ($Ni(NO_3)_2$), and a hydrate thereof. The hydrate of the nickel precursor may be at least one selected from, for example, nickel sulfate heptahydrate, nickel chloride heptahydrate, and nickel acetate heptahydrate.

In this disclosure, the metal precursor consists of a nickel precursor as an essential component, and even when the nickel precursor is used alone, the catalyst-free electroless plating occurs. Further, the metal precursor which may be added in addition to the nickel precursor is not particularly limited as long as it is a metal which may be plated on the material to be plated. The metal precursor may further include at least one selected from, but is not limited thereto, an iron precursor, a cobalt precursor, a copper precursor, a molybdenum precursor, a tungsten precursor, and a zinc precursor.

Although not limited thereto, when the concentration of the metal precursor in the composition for catalyst-free electroless plating is less than 0.0001 M or more than 0.07 M, the electroless plating reaction may not proceed.

According to one embodiment, the nickel of the nickel precursor in the composition for catalyst-free electroless plating may be contained at an atomic ratio of 2% or more with respect to the entire metal of the metal precursor. Although not limited thereto, if the content of the nickel in the nickel precursor is less than 2% with respect to the entire metal of the metal precursor, the efficiency of electroless plating may be lowered. Particularly, when the nickel is not included, the electroless plating reaction may not proceed substantially. For example, a composition for plating containing FeCo alone does not substantially proceed to the electroless plating reaction even when the reaction temperature is raised to 85° C. or higher. Although not limited thereto, the nickel precursor may be included in an amount of 1 to 20 parts by weight based on the entire metal precursor.

In this disclosure, the reducing agent is not particularly limited as long as the reducing power is large enough to reduce metal ions to deposit the metal on the surface of the material to be plated. Although not limited thereto, the reducing agent may include at least one selected from dimethylamine borane (DMAB), hydrazine, sodium hypophosphite, sodium borohydride, and formaldehyde. The reducing agent may be contained in an amount of 1 to 20 parts by weight, preferably 10 to 20 parts by weight, based on the composition for catalyst-free electroless plating. Although not limited thereto, when the reducing agent is contained in an amount of less than 1 part by weight based on the composition for catalyst-free electroless plating, the plating rate may be significantly lowered and the productivity may not be expected. On the other hand, when the reducing agent is contained in an amount exceeding 20 parts by weight, the drag-out loss may be increased since a compounding ratio of a complexing agent and the like must be increased at the same time. The drag-out loss means the amount of the composition which is deposited on the material to be plated when a plating bath is discharged after completing the plating.

According to one embodiment, a temperature of the composition for catalyst-free electroless plating may be at least 75° C. Although not limited thereto, when the temperature of the composition for catalyst-free electroless plating is higher than 65° C., the electroless plating reaction may occur, but if the temperature is lower than 75° C., the electroless plating efficiency may be lowered. Although not limited thereto, the temperature of the composition for catalyst-free electroless plating may be 80° C. or higher, preferably 90° C. or higher. As the temperature of the composition for catalyst-free electroless plating increases, the electroless plating reaction may be promoted and the saturation magnetization value of the composite of the material to be plated-magnetic particles may be increased.

In this disclosure, the composition for catalyst-free electroless plating may further include at least one of a complexing agent and a buffer. The complexing agent serves to complexity the metal precursor to stably supply metal ions. Although not limited thereto, the composition for catalyst-free electroless plating may further include at least one selected from sodium tartrate, sodium citrate, phosphorous acid, and ammonium sulfate. Although not limited thereto, the complexing agent may be included in an amount of 1 to 10 parts by weight based on the composition for catalyst-free electroless plating. If the complexing agent is contained in an amount of less than 1 part by weight based on the composition for catalyst-free electroless plating, it may be difficult to supply metal ions due to lack of complexity. On the other hand, if the amount exceeds 10 parts by weight, the drag-out loss is increased due to excess amount of metal ions and the plating rate may be remarkably lowered. It is apparent that those who are skilled in the art select and adjust appropriately kind and content of the complexing agent and the buffer.

According to another aspect, there is provided a method for catalyst-free electroless plating including: i) preparing a composition for electroless plating comprising a metal precursor comprising a nickel precursor and a reducing agent; and ii) introducing the composition for electroless plating into a dispersion solution containing a material to be plated so that a concentration of the metal precursor is 0.0001-0.07 M.

FIG. 1 is a schematic view illustrating an example of a method for catalyst-free electroless plating.

Referring to FIG. 1, a composition for electroless plating including a metal precursor including a nickel precursor and a reducing agent is added into an aqueous graphene dispersion solution 20 which is a dispersion solution containing a material to be plated. This conflicts with a conventional method for electroless plating in which a dispersion solution containing a material to be plated is added to a composition for electroless plating.

As described above, the composition for electroless plating 10 is introduced into an aqueous graphene dispersion solution 20, which is a dispersion solution containing graphene 30, which is a material to be plated. A concentration of the metal precursor relative to the graphene 30 is kept relatively low to promote the growth of metal nuclei on the surface of the graphene 30. As a result, the wettability of the metal on the surface of the graphene 30 may be improved. Unlike the conventional electroless plating method, electroless plating may be performed on the material to be plated without a catalyst such as a noble metal catalyst. Therefore, when the composition for catalyst-free electroless plating of this disclosure is used, a catalyst pre-treatment step, which is required with the conventional electroless plating, is not required. Electroless plating may be thus performed in a single step. In addition, since a catalyst such as an expensive noble metal catalyst is not required, a manufacturing cost for the electroless plating may be reduced.

In step ii), the composition for electroless plating is preferably added to the dispersion solution containing the material to be plated so that the concentration of the metal precursor is 0.0001-0.07 M. If the concentration of the metal precursor in the dispersion solution containing the material to be plated is less than 0.0001 M or exceeds 0.07 M, the electroless plating reaction may not proceed substantially. The concentration of the metal precursor to the material to be plated may be controlled by adjusting an addition amount of the composition for electroless plating. Although not limited thereto, the metal precursor may be contained in an amount of 1 to 60 parts by weight based on the composition for catalyst-free electroless plating. Although not limited thereto, when the metal precursor is contained in an amount of 50 to 60 parts by weight based on the composition for catalyst-free electroless plating, it may be added at a rate of 2 to 50 ml/min.

According to one embodiment, the step i) of the method for catalyst-free electroless plating may further include adjusting the pH of the composition for catalyst-free electroless plating to at least 6.5, preferably at least 7.5, and more preferably at least 9.5. The electroless plating reaction may be carried out even though the pH of the composition for catalyst-free electroless plating is not controlled. However, if the pH of the composition for catalyst-free electroless plating is 6.5 or more, the electroless plating reaction may be promoted and the saturation magnetization value of a composite of the material to be plated-magnetic particles may be increased.

According to one embodiment, the step of i) of the method for catalyst-free electroless plating may further include heating the composition for catalyst-free electroless plating to 75° C. or higher, preferably 80° C. or higher, and more preferably 90° C. or higher. As the temperature of the composition for catalyst-free electroless plating increases, the electroless plating reaction may be promoted and the saturation magnetization value of the composite of the material to be plated-magnetic particles may be increased.

According to one embodiment, the step ii) of the method for catalyst-free electroless plating may be maintained for at least one minute to promote nuclear growth. Although not limited thereto, it may be appropriate to maintain the above-mentioned introducing of the composition for electroless plating for 5 to 10 minutes. If the introducing step is less than one minute, the metal nuclear growth is not sufficiently performed on the surface of the material to be plated, so that the electroless plating reaction may not proceed substantially.

Although not limited thereto, the composition for electroless plating may be added at a rate of 2 to 50 ml/min. When the composition for electroless plating is slowly added and the concentration of the metal precursor is kept relatively low, the growth of metal nuclei on the surface of the material to be plated may be promoted and the wettability of the metal may be improved. The adding rate may be appropriately adjusted in consideration of the desired concentration of the metal precursor contained in the composition for catalyst-free electroless plating.

According to one embodiment, after the metal nucleation is completed, the remaining composition for electroless plating may be added at once into the dispersion solution containing the material to be plated, thereby shortening the plating time. After the metal nucleation is completed, the plating amount increases in proportion to the addition amount of the composition for electroless plating.

According to one embodiment, the step ii) of the method for catalyst-free electroless plating may further include controlling the pH of the dispersion solution containing the material to be plated to at least 6.5, preferably at least 7.5, and more preferably at least 9.5. However, it is not limited thereto. If the pH of the composition for catalyst-free electroless plating is 6.5 or more, the electroless plating reaction may be promoted and the saturation magnetization value of the composite of the material to be plated-magnetic particles may be increased.

Hereinafter, this disclosure will be described in more detail with reference to examples. It is to be understood, however, that these examples are for illustrative purposes only and are not to be construed as limiting the scope of this disclosure.

EXAMPLES

Example 1. Electroless Plating Using a Composition for Catalyst-Free Electroless Plating Electroless plating using a composition for catalyst-free electroless plating was carried as follows.

0.2 g of graphene, which was a material to be plated, was dispersed in 50 ml of water and pH was adjusted to 9.5 with sodium hydroxide (NaOH). The result solution was heated to a temperature of 95° C. to provide an aqueous graphene dispersion solution.

Next, a composition for electroless plating at pH of 9.5 and temperature of 95° C. containing a metal precursor, a reducing agent, a complexing agent and a buffer with the compositions shown in the following Table 1 was prepared.

TABLE 1

| | |
|---|---|
| DMAB | 15.32 g |
| Sodium tartrate | 46.016 g |
| Sodium citrate | 14.71 g |
| Phosphorous acid | 4.9 g |
| Ammonium sulfate | 26.43 g |
| Cobalt sulfate hepatahydrate | 15.223 g |

TABLE 1-continued

| | |
|---|---|
| Iron sulfate heptahydrate | 2.537 g |
| Nickel sulfate heptahydrate | 1.894 g |
| Sodium hydroxide | pH 9.5 |
| DI water | 1000 ml |

The prepared composition for electroless plating was added to the aqueous graphene dispersion solution at a rate of 2 ml/min for 10 minutes so that the concentration of the metal precursor added to the aqueous graphene dispersion solution was kept to be 0.005M at the beginning. (See FIG. 1).

The remaining composition for electroless plating was then added at once to the aqueous graphene dispersion solution.

The reaction was continued for a total of 30 minutes from the time of introducing the composition for electroless plating, and the plated graphene was then obtained through filtering.

Figure 2:
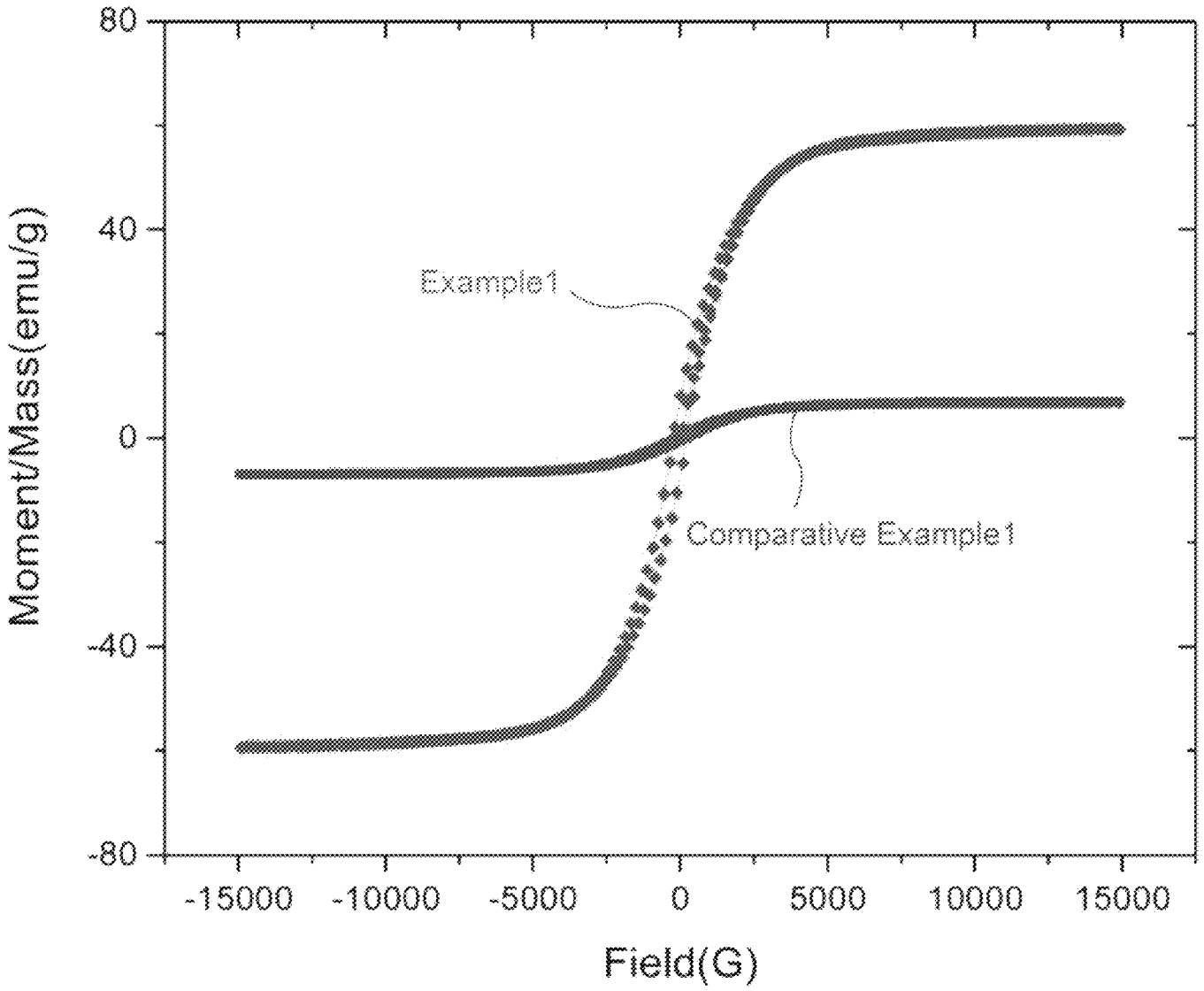
FIG. 2 is graphs illustrating the relationship between the saturation magnetization value of a graphene-magnetic particle composite after plating graphene by an example of a method for catalyst-free electroless plating (Example 1) and the saturation magnetization value of a graphene-magnetic particle composite after plating graphene by a conventional electroless plating without using a catalyst (Comparison Example 1).

The saturation magnetization value of the result composite of graphene-magnetic particles was measured and shown in FIG. 2. As shown in FIG. 2, it was confirmed that the saturation magnetization value of the composite of graphene-magnetic particles obtained through the catalyst-free electroless plating of Example 1 was 59.32 emu/g and the plating was excellent without any catalyst.

Comparative Example 1

An aqueous graphene dispersion solution and a composition for electroless plating were prepared in the same manner as in Example 1.

The aqueous graphene dispersion solution was added to the composition for electroless plating at once.

The same aqueous graphene dispersion solution and the same composition for electroless plating were used, but addition of the aqueous graphene dispersion solution to the composition for electroless plating was different in Comparative Example 1, which was different from Example 1.

The saturation magnetization value of the result composite of graphene-magnetic particles was measured and shown in FIG. 2. As shown in FIG. 2, it was confirmed that the saturation magnetization value of the composite of graphene-magnetic particles obtained through the catalyst-free electroless plating of Comparative Example 1 was 6.91 emu/g and the plating was hardly proceeded.

Example 2-Example 5 and Comparative Example 2: Catalyst-Free Electroless Plating for Various Materials to be Plated Example 2-Example 5 and Comparative Example 2 were performed using the same composition for electroless plating and the same method for catalyst-free electroless plating in the same manner as in Example 1, except for using different materials to be plated.

More particularly, the material to be plated was carbon nanotube (CNT) for Example 2, glass fiber for Example 3, carbon black for Example 4, carbon fiber for Example 5, and graphene oxide for Comparative Example 2.

Figure 3:
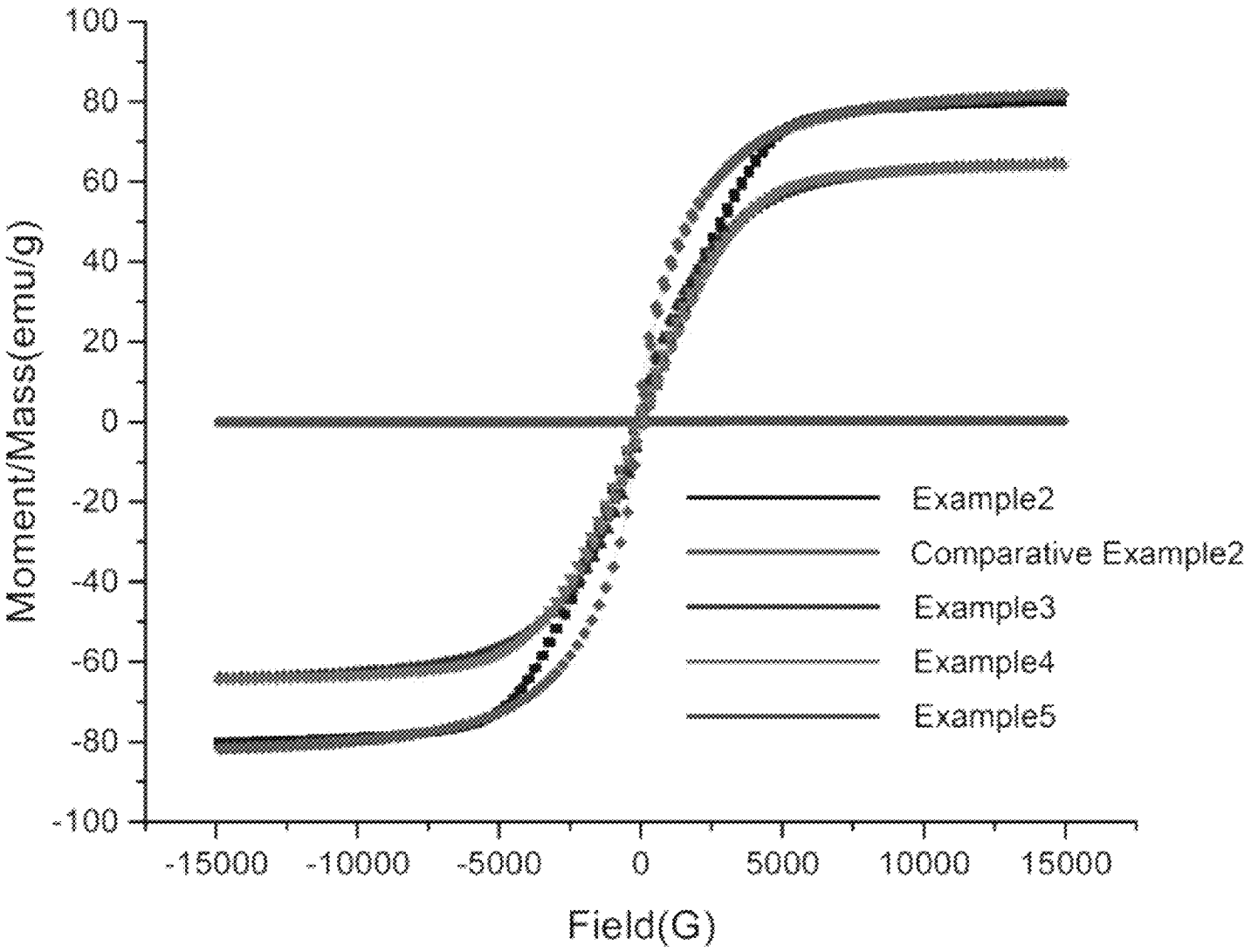
FIG. 3 is a graph illustrating saturation magnetization values of materials to be plated-magnetic particle composite after plating various kinds of materials to be plated by an example of a method for catalyst-free electroless plating.

The saturation magnetization value of the result composite of material to be plated-magnetic particles was measured and shown in FIG. 3. As shown in FIG. 3, it was confirmed that the saturation magnetization value of the composite of carbon nanotube-magnetic particles obtained through the catalyst-free electroless plating of Example 2 was 80.07 emu/g and the plating was excellent without any catalyst. It was also confirmed that the saturation magnetization value of the composite of glass fiber-magnetic particles obtained through the catalyst-free electroless plating of Example 3 was 64.33 emu/g and the plating was excellent without any catalyst. It was also confirmed that the saturation magnetization value of the composite of carbon black-magnetic particles obtained through the catalyst-free electroless plating of Example 4 was 64.32 emu/g and the plating was excellent without any catalyst. It was further confirmed that the saturation magnetization value of the composite of carbon fiber-magnetic particles obtained through the catalyst-free electroless plating of Example 5 was 81.79 emu/g and the plating was excellent without any catalyst. Particularly, the catalyst-free electroless plating for the carbon nano tube or the carbon fiber was found to be excellent without catalyst.

On the other hand, it was confirmed that the saturation magnetization value of the composite of graphene oxide-magnetic particles obtained through the catalyst-free electroless plating of Comparative Example 2 was 0.14 emu/g and the plating was hardly proceeded.

Example 6-Example 15: Changes in Magnetic Properties of a Material to be Plated Depending on the Metal Concentration During Plating by a Method for Catalyst-Free Electroless Plating Example 6-Example 15 were performed using the same composition for electroless plating and the same method for catalyst-free electroless plating in the same manner as in Example 1, except for using different concentrations of the metal precursor in the composition for catalyst-free electroless plating.

Figure 4A:
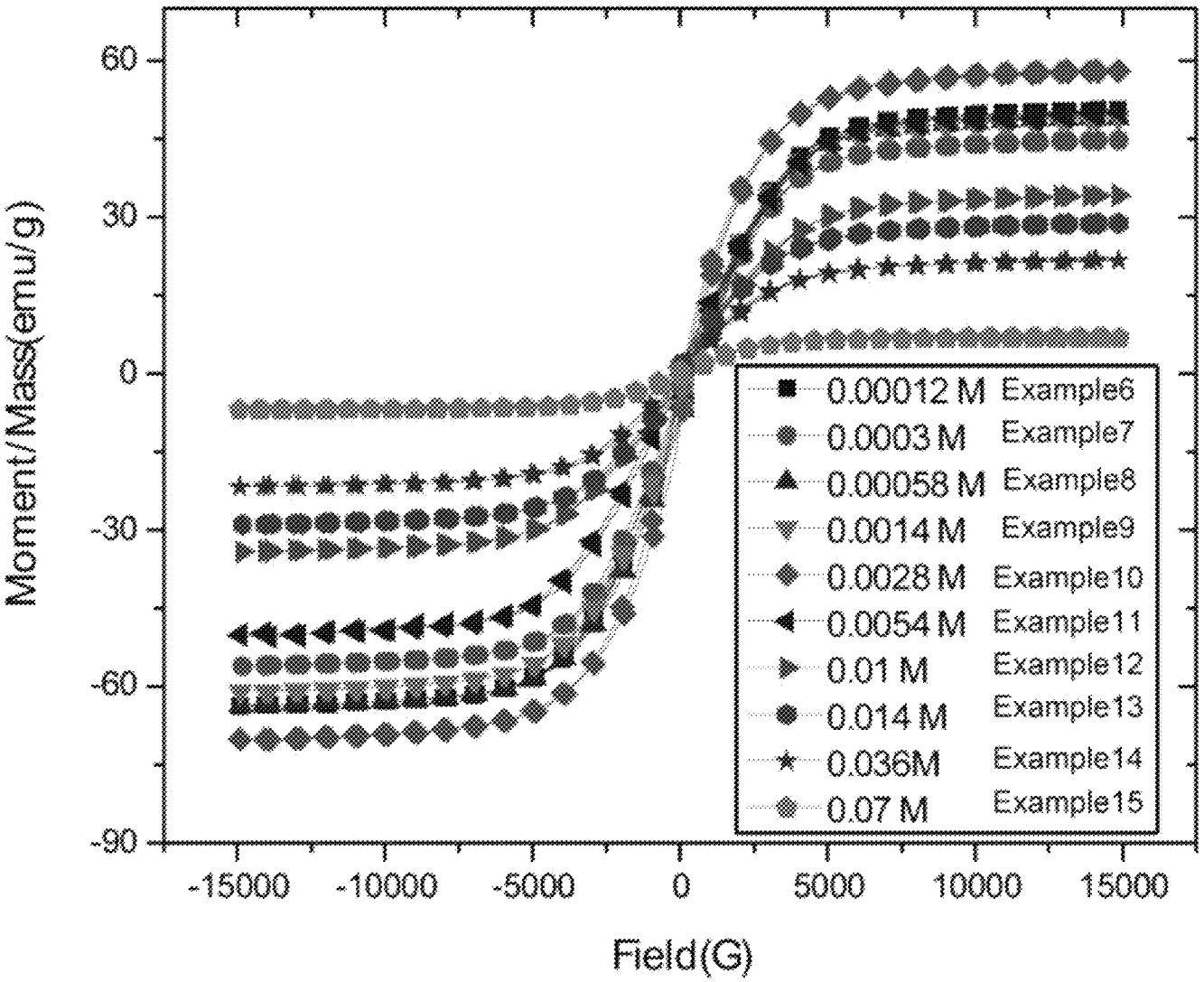
FIG. 4A and FIG. 4B are graphs illustrating saturation magnetization values of a graphene-magnetic particle composite depending on a metal concentration during plating by an example of a method for catalyst-free electroless plating.
Figure 4B:
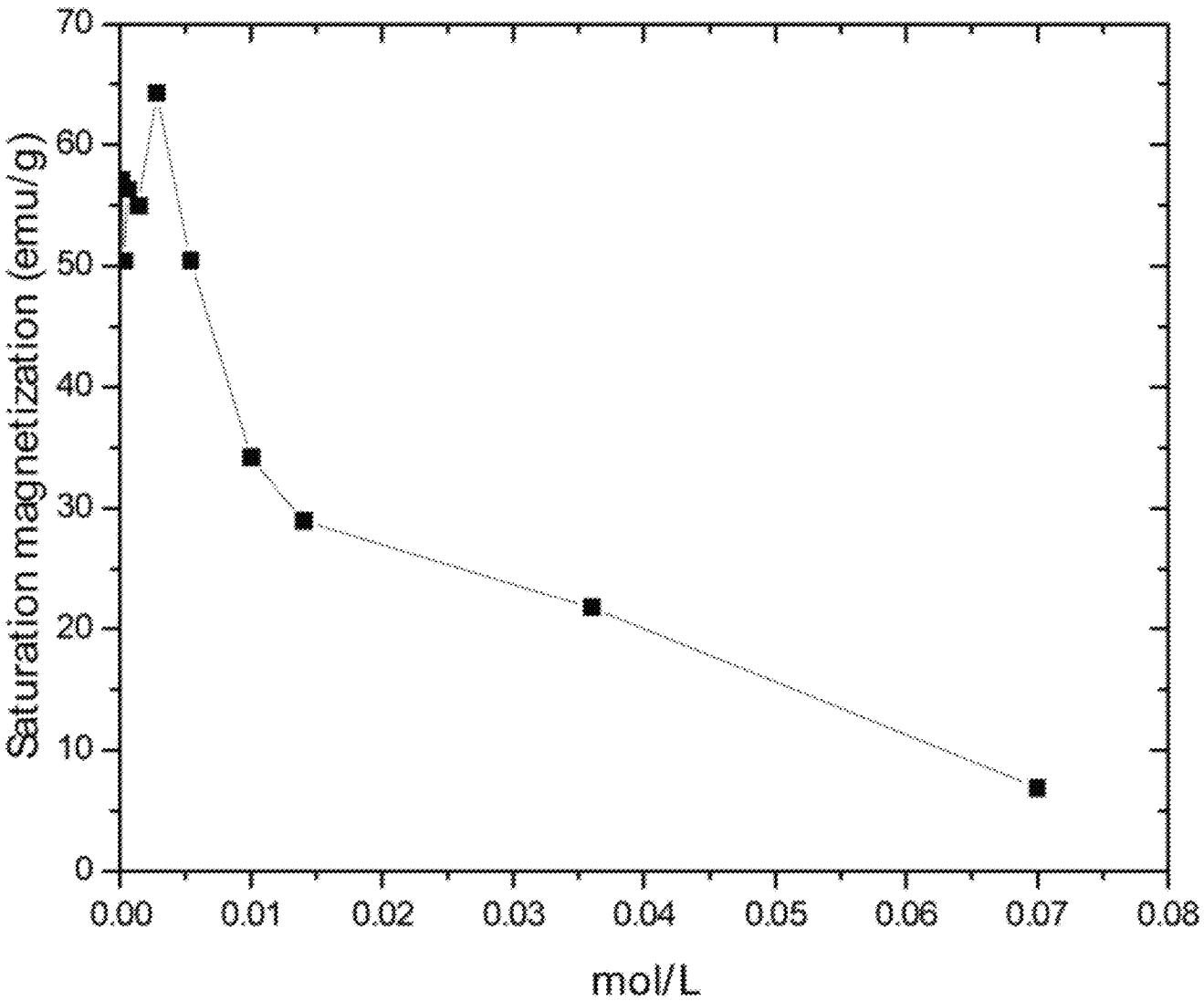

The saturation magnetization values of the result composites of graphene-magnetic particles were measured and shown in FIG. 4A and FIG. 4B. As shown in FIG. 4A and FIG. 4B, it was confirmed that when the concentration of the metal precursor in the composition for catalyst-free electroless plating exceeds 0.07 M, the plating reaction did not substantially occur without the catalyst. On the other hand, when the concentration of the metal precursor in the composition for catalyst-free electroless plating was in the range of 0.0001-0.01 M, the plating reaction actively occurred and the plating process was excellent without the catalyst.

Example 16-Example 18 and Comparative Example 3: Changes in Magnetic Properties of a Material to be Plated Depending on the Nickel Concentration During Plating by a Method for Catalyst-Free Electroless Plating Example 16-Example 18 and Comparative Example 3 were performed using the same composition for electroless plating and the same method for catalyst-free electroless plating in the same manner as in Example 6, except for using different concentrations of nickel in the composition for catalyst-free electroless plating.

Figure 5:
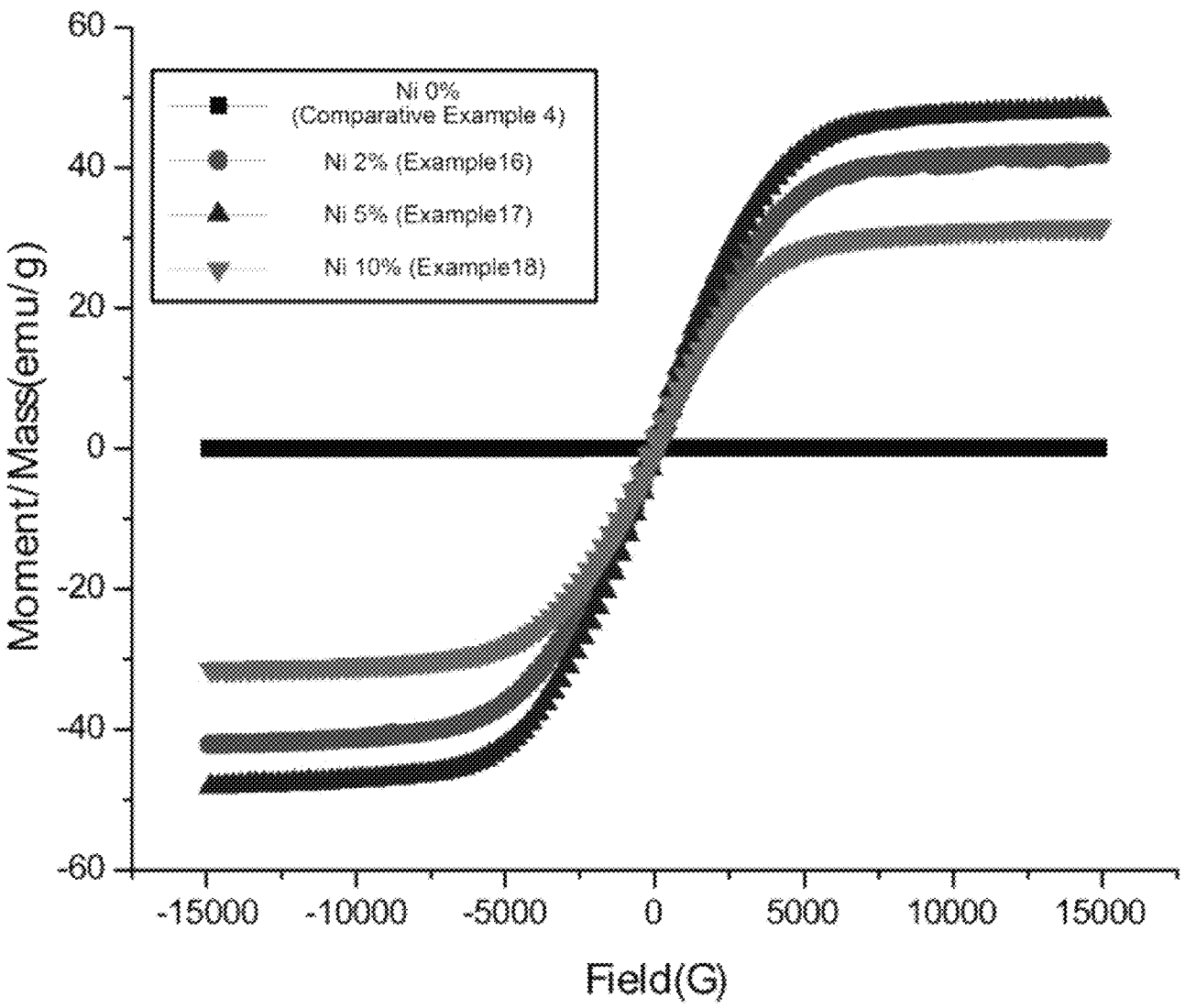
FIG. 5 is a graph illustrating saturation magnetization values of a graphene-magnetic particle composite depending on a nickel concentration during plating by an example of a method for catalyst-free electroless plating.

The saturation magnetization value of the result composite of graphene-magnetic particles was measured and shown in FIG. 5. As shown in FIG. 5, it was confirmed that when the concentration of nickel in the composition for catalyst-free electroless plating was 0% and only FeCo was contained (Comparative Example 1), the plating reaction did not substantially occur even when the reaction temperature was increased to 85° C. or 95° C. On the other hand, when the concentration of nickel in the composition for catalyst-free electroless plating was 2% or more (Example 16 to Example 18), the plating reaction occurred and the plating reaction became more active as the nickel concentration increased.

Example 19-Example 21 and Comparative Example 4: Changes in Magnetic Properties of a Material to be Plated Depending on the Temperature During Plating by the Method for Catalyst-Free Electroless Plating In order to investigate changes in magnetic properties of a material to be plated depending on the temperature during plating by the method for catalyst-free electroless plating, catalyst-free electroless plating was performed by changing temperature of the composition for catalyst-free electroless plating containing the aqueous graphene dispersion solution. Example 19-Example 21 and Comparative Example 4 were performed using the same composition for catalyst-free electroless plating and the same method for catalyst-free electroless plating in the same manner as in Example 6, except for the temperature.

Figure 6:
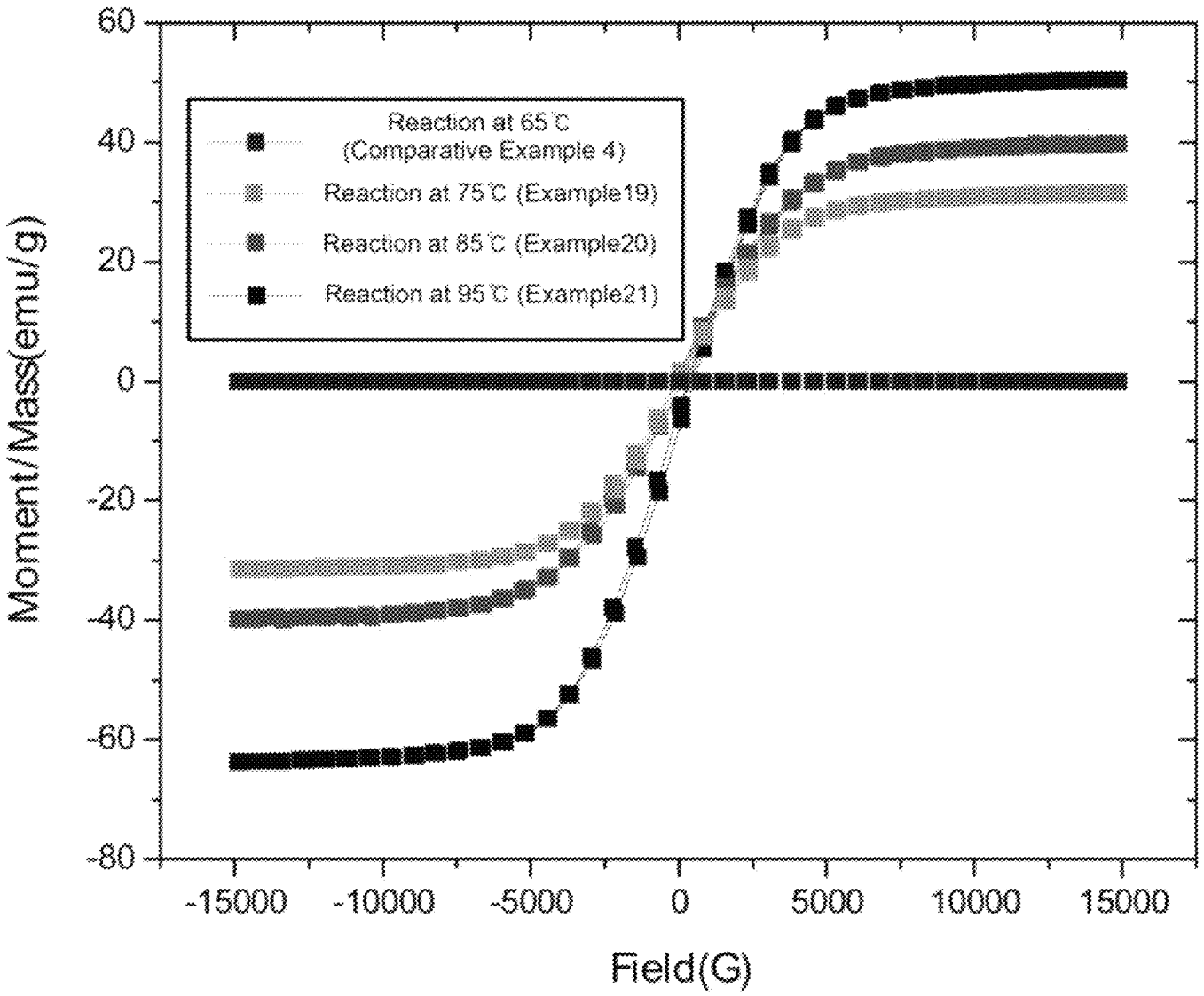
FIG. 6 is a graph illustrating saturation magnetization values of a graphene-magnetic particle composite depending on temperature during plating by an example of a method for catalyst-free electroless plating.

The saturation magnetization value of the result composite of graphene-magnetic particles was measured and shown in FIG. 6. As shown in FIG. 6, it was confirmed that when the temperature of the composition for catalyst-free electroless plating was 65° C. (Comparative Example 4), the plating reaction did not substantially occur. On the other hand, when the temperature of the composition for catalyst-free electroless plating was 75° C. or higher (Example 19 to Example 21), the plating reaction actively occurred.

Examples 22 and 23: Changes in Magnetic Properties of a Material to be Plated Depending on pH During Plating by the Method for Catalyst-Free Electroless Plating In order to investigate changes in magnetic properties of a material to be plated depending on pH during plating by the method for catalyst-free electroless plating, catalyst-free electroless plating was performed by changing pH of the composition for catalyst-free electroless plating containing the aqueous graphene dispersion solution. Example 22 and Example 23 were performed using the same composition for catalyst-free electroless plating and the same method for catalyst-free electroless plating in the same manner as in Example 6, except for pH.

Figure 7:
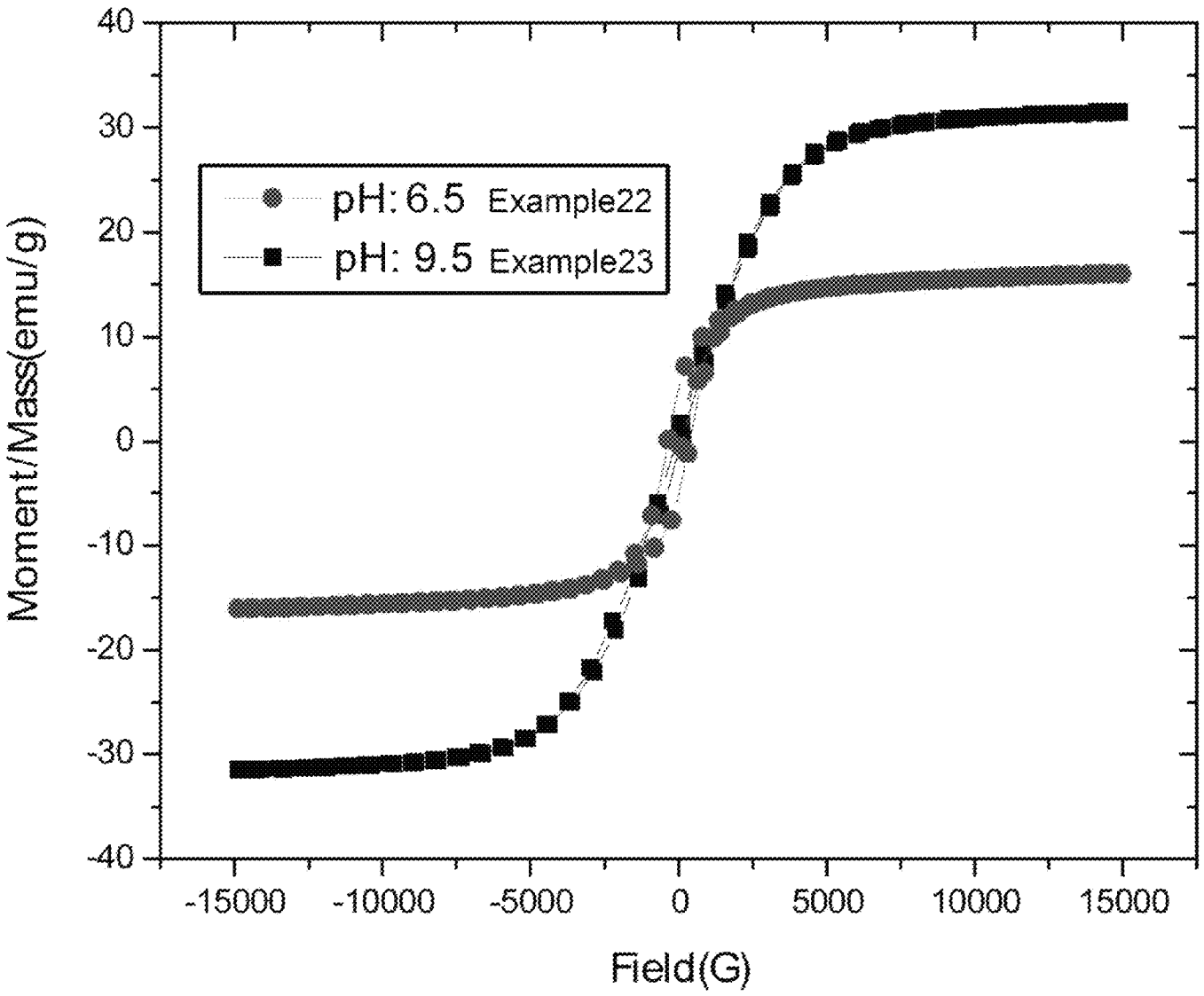
FIG. 7 is a graph illustrating saturation magnetization values of a graphene-magnetic particle composite depending on pH during plating by an example of a method for catalyst-free electroless plating.

The saturation magnetization value of the result composite of graphene-magnetic particles was measured and shown in FIG. 7. As shown in FIG. 7, it was determined that when the pH of the composition for catalyst-free electroless plating containing the aqueous graphene dispersion solution was adjusted to 6.5 and the temperature was adjusted to 75° C., the saturation magnetization value of the composite of graphene-magnetic particles was 16.1 emu/g (Example 22) and when the pH of the composition for catalyst-free electroless plating containing the aqueous graphene dispersion solution was adjusted to 9.5 and the temperature was adjusted to 75° C., the saturation magnetization value of the composite of graphene-magnetic particles was 59.3 emu/g (Example 23).

It was, therefore, confirmed that the plating become more active as the pH and the temperature of the composition for catalyst-free electroless plating including the aqueous graphene dispersion solution is increased.

Figure 8:
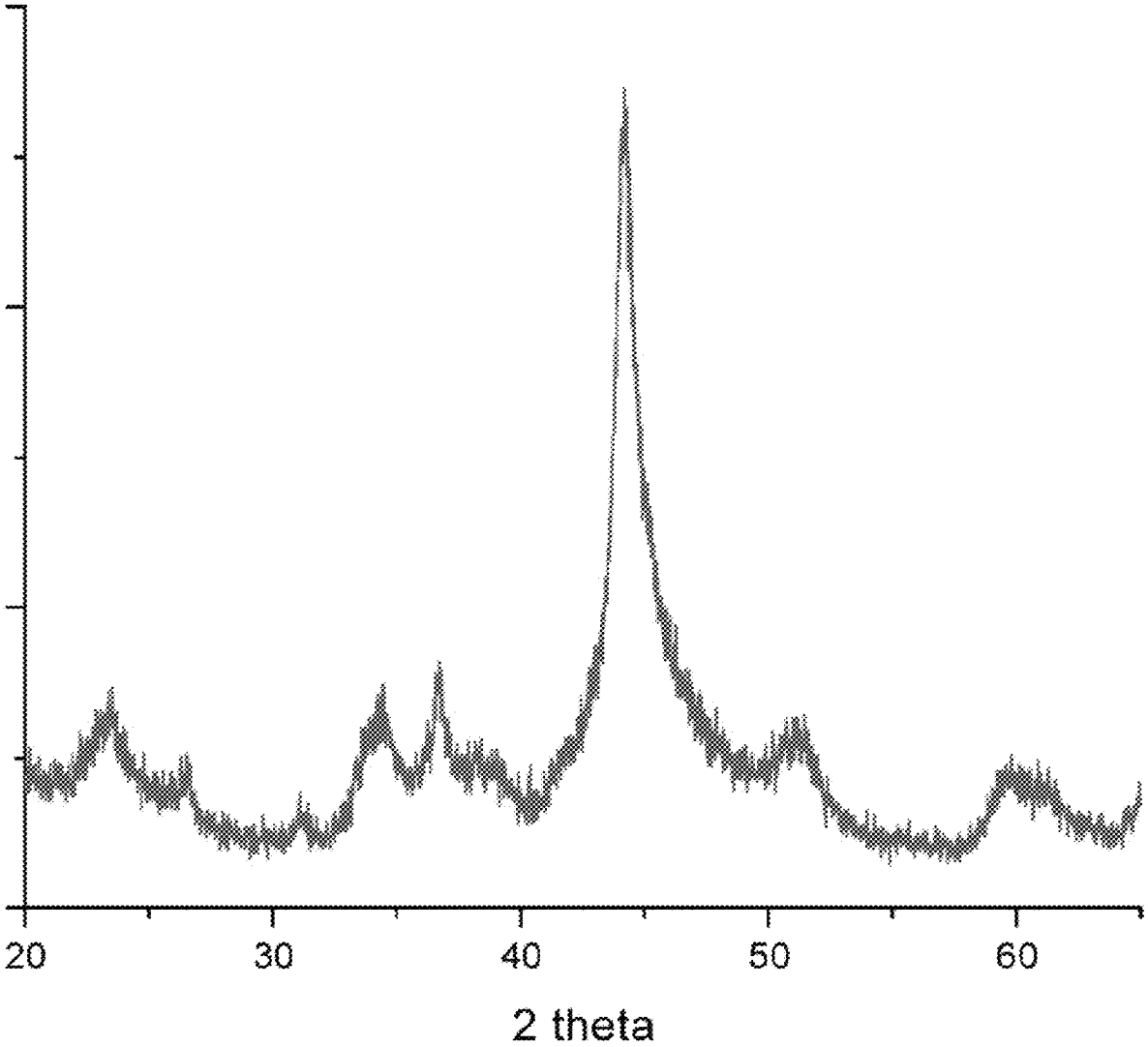
FIG. 8 is an XRD graph illustrating structural characteristics of a material plated by an example of a method for catalyst-free electroless plating.

FIG. 8 is a graph illustrating structural characteristics of a material plated by the method for catalyst-free electroless plating. The highest peak in FIG. 8 is the FeCoNi FCC (111) peak, which is the main peak of FeCoNi observed when the plating was normally grown. As shown in FIG. 8, it was noted that the plating process of this disclosure was excellent.

Example 24-Example 26: Changes in Magnetic Properties of a Material to be Plated Depending on a Ratio of Graphene to Metal in the Composition for Catalyst-Free Electroless Plating During Plating by the Method for Catalyst-Free Electroless Plating In order to investigate changes in magnetic properties of a material to be plated depending on a ratio of graphene to metal in the composition for catalyst-free electroless plating during plating by the method for catalyst-free electroless plating, catalyst-free electroless plating was performed by changing a ratio of graphene to metal in the composition for catalyst-free electroless plating containing the aqueous graphene dispersion solution. Example 24 to Example 26 were performed using the same composition for catalyst-free electroless plating and the same method for catalyst-free electroless plating in the same manner as in Example 6, except for a ratio of graphene to metal in the composition for catalyst-free electroless plating.

Figure 9:
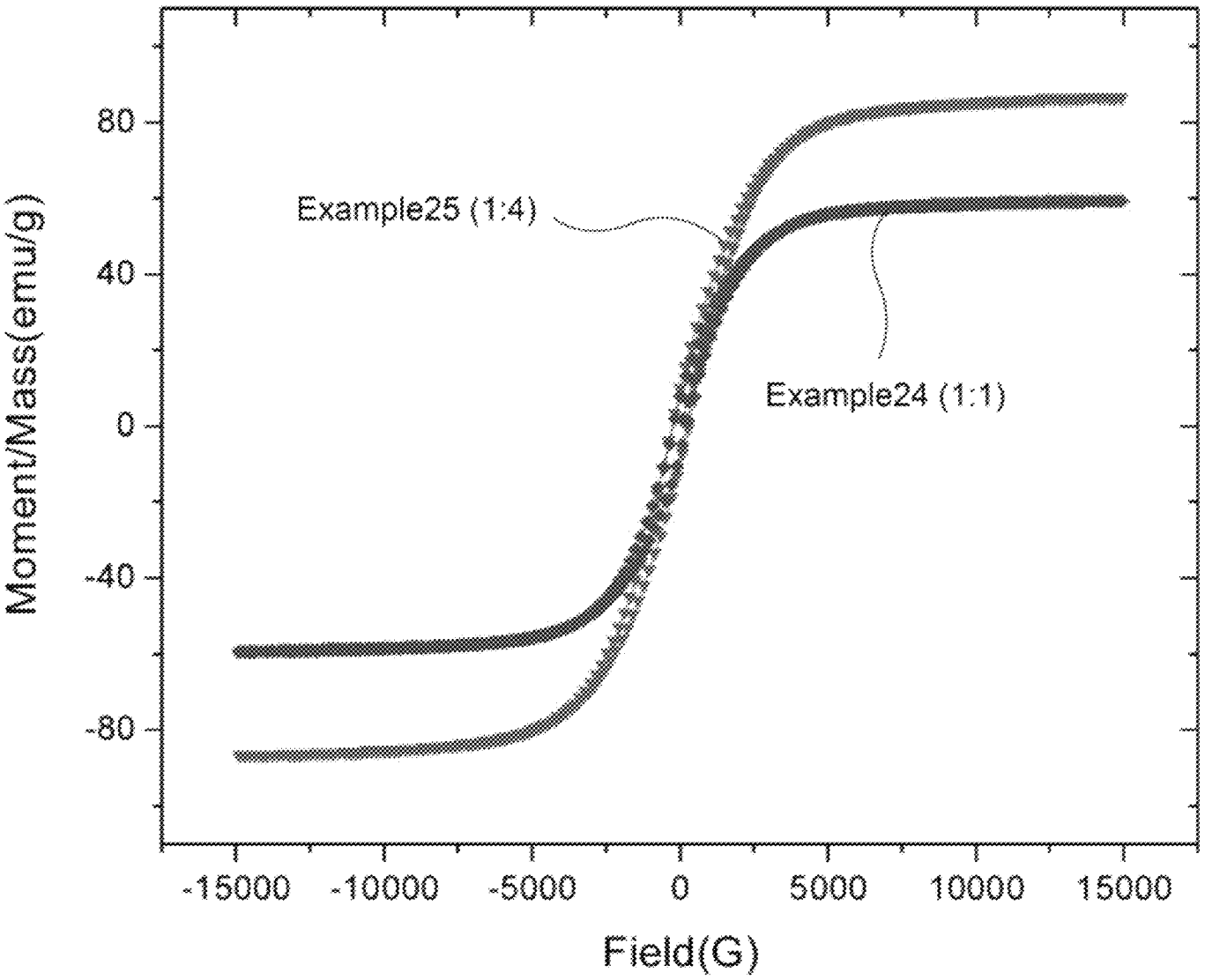
FIG. 9 is a graph illustrating saturation magnetization values of a graphene-magnetic particle composite depending on a ratio between graphene and metal in a composition for catalyst-free electroless plating during plating by an example of a method for catalyst-free electroless plating.
Figure 10A:
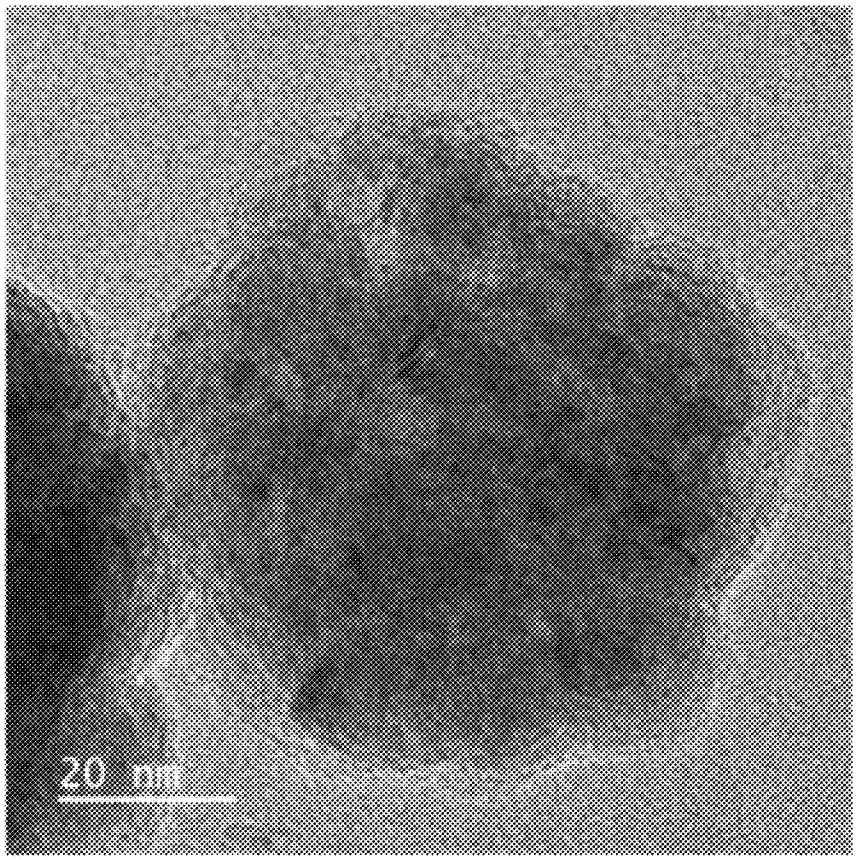
FIG. 10A is TEM images illustrating microstructure of graphene plated by an example of a method for catalyst-free electroless plating, wherein a ratio of graphene to metal in a composition for catalyst-free electroless plating is 1:1.
Figure 10A:
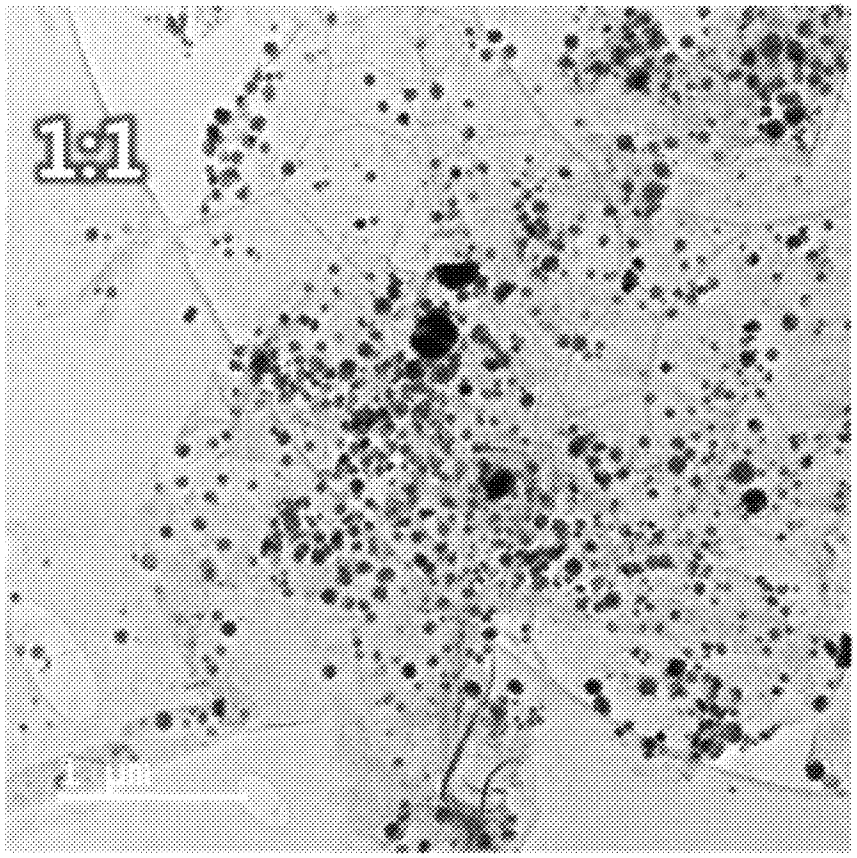
Figure 10B:
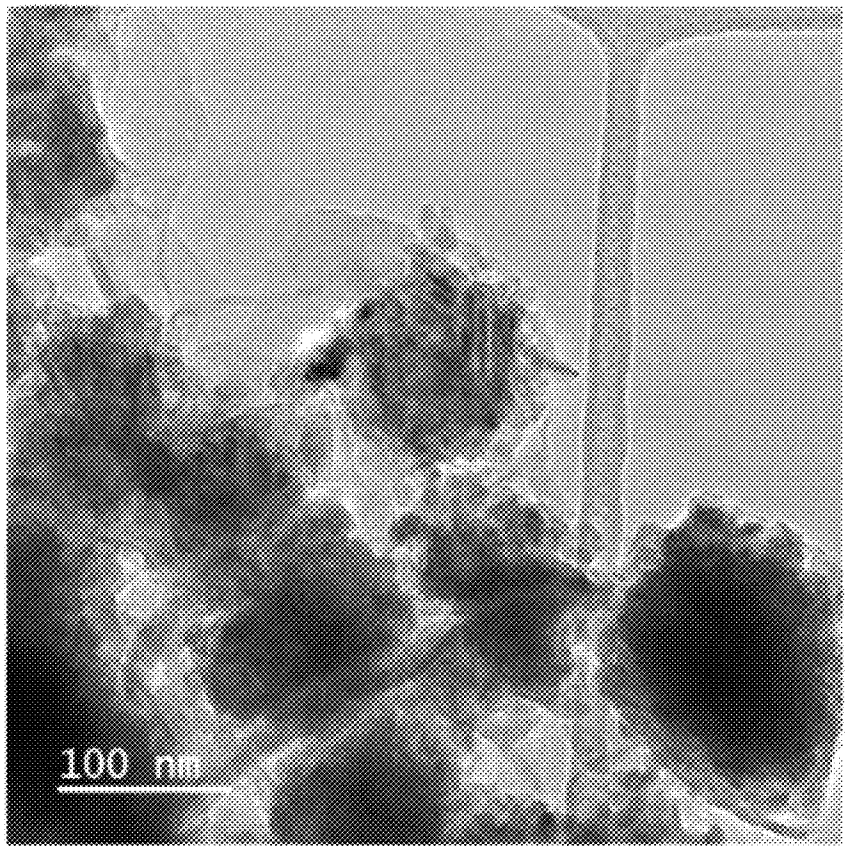
FIG. 10B is TEM images illustrating microstructure of graphene plated by an example of a method for catalyst-free electroless plating, wherein a ratio of graphene to metal in a composition for catalyst-free electroless plating is 1:4.
Figure 10B:
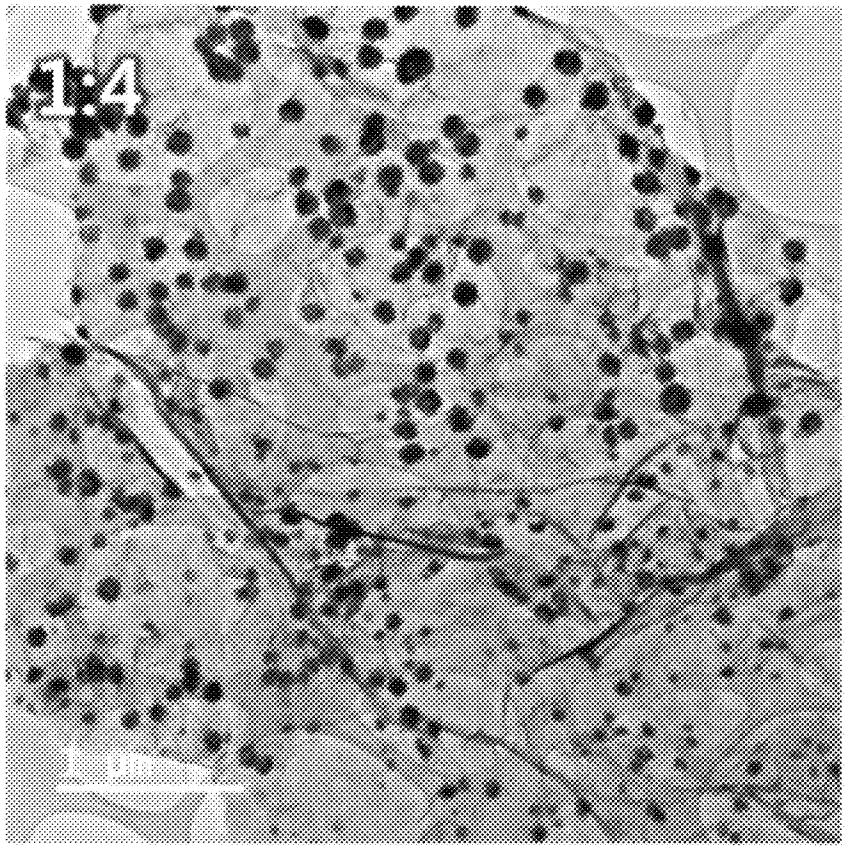
Figure 10C:
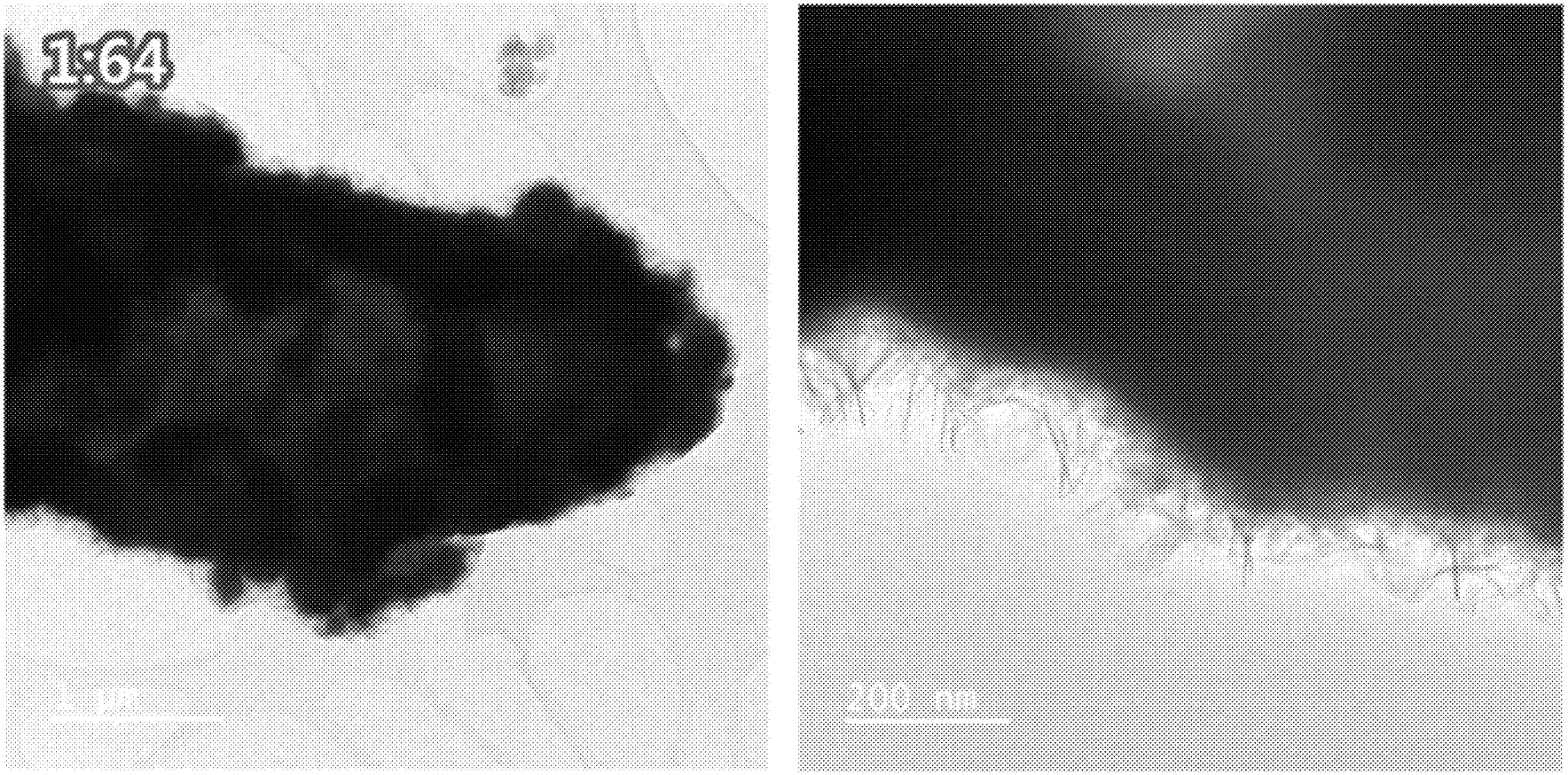
FIG. 10C is TEM images illustrating microstructure of graphene plated by an example of a method for catalyst-free electroless plating, wherein a ratio of graphene to metal in a composition for catalyst-free electroless plating is 1:64.

The saturation magnetization value of the result composite of graphene-magnetic particles was measured and shown in FIG. 9 to FIG. 10C. As shown in FIG. 9 and FIG. 10A, it was determined that when the ratio of graphene to metal in the composition for catalyst-free electroless plating was adjusted to 1:1, the saturation magnetization value of the composite of graphene-magnetic particles was 59.32 emu/g (Example 24). As shown in FIG. 9 and FIG. 10B, it was determined that when the ratio of graphene to metal in the composition for catalyst-free electroless plating was adjusted to 1:4, the saturation magnetization value of the composite of graphene-magnetic particles was 86.72 emu/g (Example 25). It was, therefore, confirmed that the plating become more active as the ratio of graphene to metal in the composition for catalyst-free electroless plating is increased.

FIG. 10A is images illustrating the microstructure of graphene plated by the method for catalyst-free electroless plating, wherein the ratio of graphene to metal in the composition for catalyst-free electroless plating is 1:1 (Example 24). FIG. 10B is images illustrating the microstructure of graphene plated by the method for catalyst-free electroless plating, wherein the ratio of graphene to metal in the composition for catalyst-free electroless plating is 1:4 (Example 25). As shown in FIG. 10A and FIG. 10B, it was confirmed that when the ratio of graphene to metal in the composition for catalyst-free electroless plating is relatively low, the metal grows as nanoparticles on the surface of graphene.

FIG. 10C is images illustrating the microstructure of graphene plated by the method for catalyst-free electroless plating, wherein the ratio of graphene to metal in the composition for catalyst-free electroless plating is 1:64 (Example 26). As shown in FIG. 10C, it was confirmed that when the ratio of graphene to metal in the composition for catalyst-free electroless plating is relatively high, the metal covers the entire surface of the graphene, so that a plate-like hybrid material may be synthesized.

Example 27: Changes in Magnetic Properties of a Material to be Plated by Using a Composition for Catalyst-Free Electroless Plating Including Only a Nickel Precursor as a Metal Precursor in Plating by the Method for Catalyst-Free Electroless Plating Example 27 was performed using a composition for catalyst-free electroless plating including only a nickel precursor as the metal precursor, instead of the iron precursor, the cobalt precursor, and the nickel precursor as the metal precursor, in order to investigate changes in magnetic properties of the material to be plated by using the composition for catalyst-free electroless plating including only a nickel precursor as the metal precursor in plating by the method for catalyst-free electroless plating.

Particularly, 0.2 g of graphene as the material to be plated was dispersed in 50 ml of water, the pH was adjusted to 9.5 with sodium hydroxide (NaOH), and a temperature was raised to 85° C. to provide an aqueous graphene dispersion solution.

Next, a composition for electroless plating including the metal precursor, the reducing agent, the complexing agent, and the buffer shown in Table 1 was prepared at pH of 9.5 and temperature of 85° C., wherein the iron precursor, the cobalt precursor, and the nickel precursor as the metal precursor was replaced with the nickel precursor.

The prepared composition for electroless plating was added to the aqueous graphene dispersion solution at a rate of 2 ml/min for 10 minutes so that the concentration of the metal precursor added to the aqueous graphene dispersion solution was 0.005M at the beginning of adding the composition for the electroless plating.

The remaining composition for electroless plating was then added to the aqueous graphene dispersion solution at once.

The reaction was continued for a total of 30 minutes from the time of adding the composition for electroless plating, and the plated graphene was obtained through filtering.

Figure 11A:
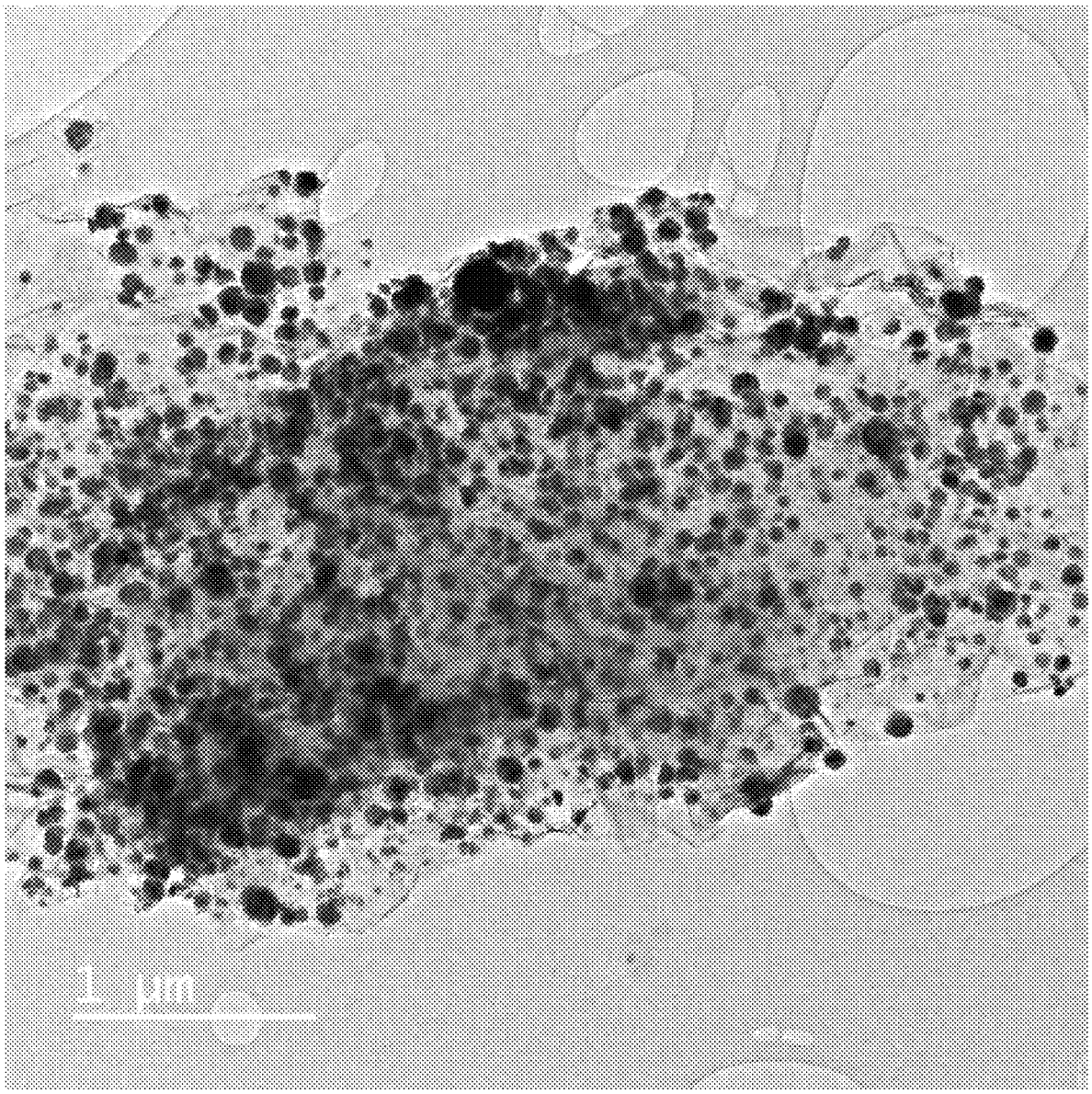
FIG. 11A is a TEM image illustrating microstructure of graphene plated by an example of a method for catalyst-free electroless plating, wherein a metal precursor in a composition for catalyst-free electroless plating contains only a nickel precursor.
Figure 11B:
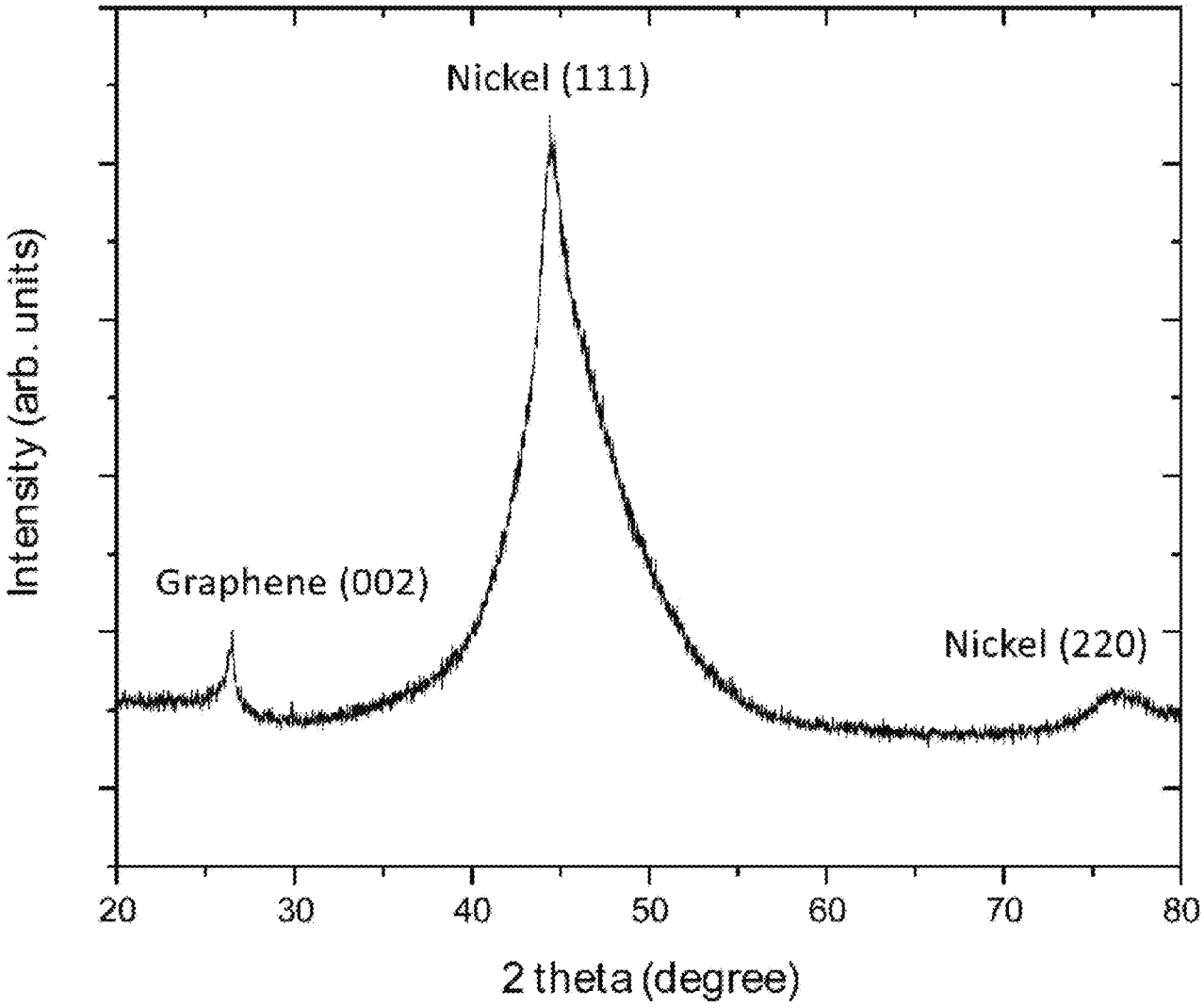
FIG. 11B is an XRD graph illustrating structural characteristics of graphene plated by an example of a method for catalyst-free electroless plating, wherein a metal precursor in a composition for catalyst-free electroless plating contains only a nickel precursor.

The structural characteristics of the plated material were analyzed and shown in FIG. 11A and FIG. 11B. FIG. 11A is a TEM image illustrating the microstructure of graphene plated by the method for catalyst-free electroless plating, wherein the metal precursor in the composition for catalyst-free electroless plating contains only the nickel precursor. FIG. 11B is an XRD graph illustrating structural characteristics of graphene plated by the method for catalyst-free electroless plating, wherein the metal precursor in the composition for catalyst-free electroless plating contains only the nickel precursor.

As shown in FIGS. 11A and 11B, it was confirmed in the TEM and XRD images that the nickel was well plated without catalyst in the same manner as in the case of using the iron precursor, the cobalt precursor and the nickel precursor as the metal precursor.

Example 28: Changes in Magnetic Properties of a Material to be Plated by Using a Composition for Catalyst-Free Electroless Plating Including a Nickel Precursor and a Copper Precursor as a Metal Precursor in Plating by the Method for Catalyst-Free Electroless Plating Example 28 was performed using a composition for catalyst-free electroless plating including a nickel precursor and a copper precursor as the metal precursor, wherein an iron precursor and a cobalt precursor was replaced with the copper precursor, in order to investigate changes in magnetic properties of the material to be plated by using the copper precursor as the metal precursor in the composition for catalyst-free electroless plating in plating by the method for catalyst-free electroless plating. The plating condition was the same as in Example 6, except that the iron precursor and the cobalt precursor of the metal precursor in the composition for catalyst-free electroless plating were replaced with the copper precursor.

Figure 12:
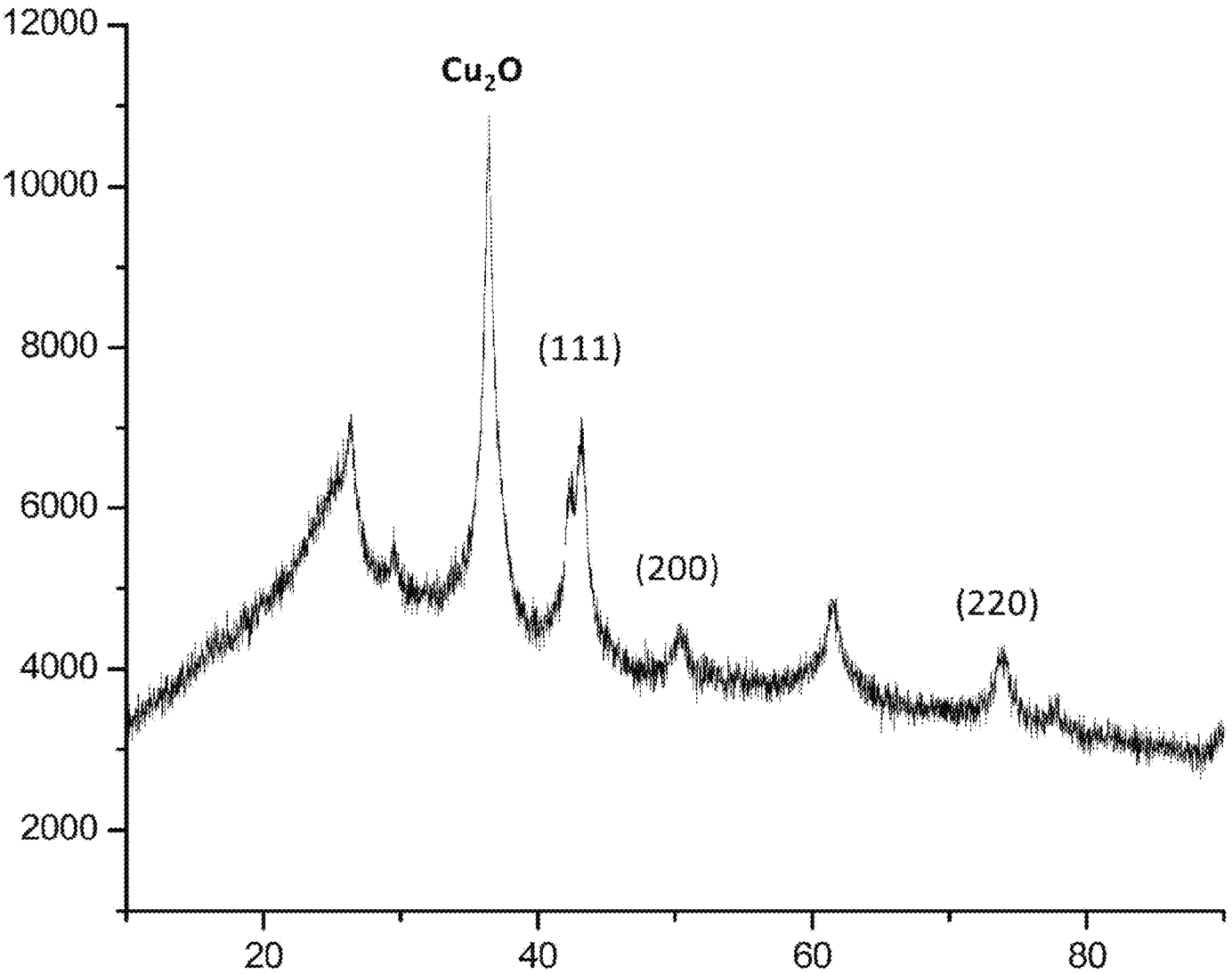
FIG. 12 is an XRD graph illustrating structural characteristics of graphene plated by an example of a method for catalyst-free electroless plating, wherein a metal precursor in a composition for catalyst-free electroless plating contains a nickel precursor and a copper precursor.

The structural characteristics of the plated material were analyzed and shown in FIG. 12. FIG. 12 is an XRD graph illustrating structural characteristics of graphene plated by the method for catalyst-free electroless plating, wherein the metal precursor in the composition for catalyst-free electroless plating contains the nickel precursor and the copper precursor.

As shown in FIG. 12, peaks of (111), (200) and (220) of Cu were observed which confirmed that the copper was well plated.

Example 29: Characteristics of a Plastic Foam Material Plated by the Method for Catalyst-Free Electroless Plating when the Plastic Foam Material is Used as a Material to be Plated in a Composition for Catalyst-Free Electroless Plating In order to investigate whether catalyst-free electroless plating occurred or not in the case of using a plastic foam as a material to be plated in the composition for catalyst-free electroless plating in plating by the method for catalyst-free electroless plating, catalyst-free electroless plating was performed by using the plastic foam as the material to be plated in the composition for catalyst-free electroless plating. Here, the plating was performed in the same manner as in Example 6, except for using the plastic foam as the material to be plated in the composition for catalyst-free electroless plating. The results are shown in FIG. 13.

Figure 13:
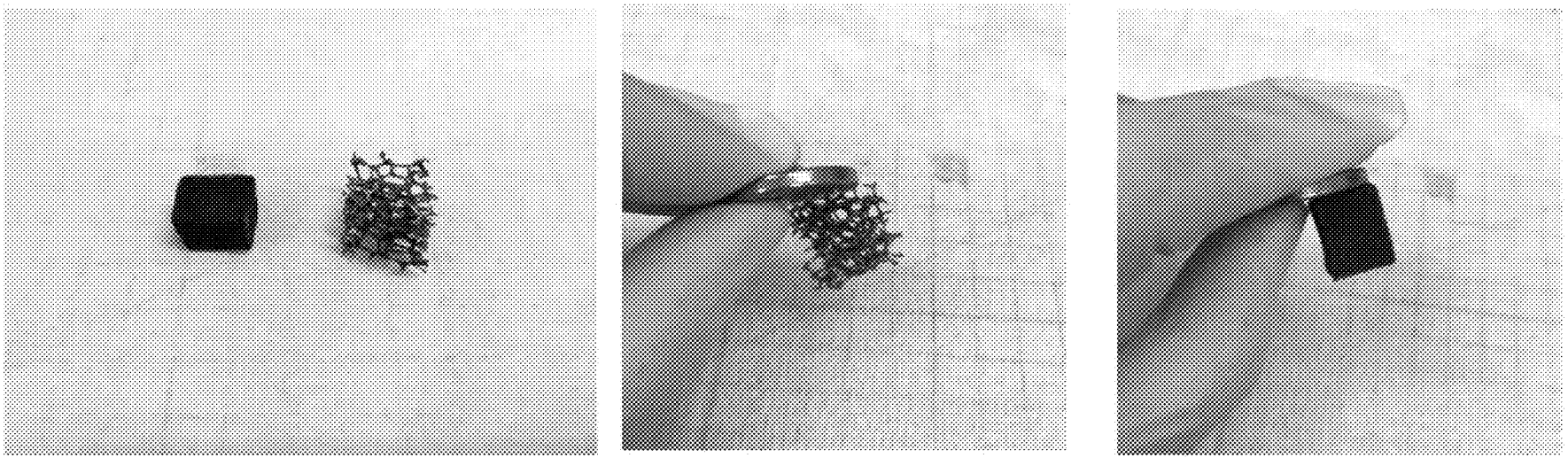
FIG. 13 is images illustrating that metal particles are well grown on a plastic foam material when the plastic foam material is used as a material to be plated in a composition for catalyst-free electroless plating during plating by an example of a method for catalyst-free electroless plating.

As shown in FIG. 13, it was confirmed that the plastic foam material was well adhered to the magnet because the catalyst-free electroless plating occurred well on the plastic foam material. Therefore, according to this disclosure, metal particles are well grown by the method for catalyst-free electroless plating not only on carbon materials but also on general plastic materials.

Example 30: Characteristics of a Fiber Material Plated by the Method for Catalyst-Free Electroless Plating when the Fiber Material is Used as a Material to be Plated in a Composition for Catalyst-Free Electroless Plating In order to investigate whether catalyst-free electroless plating occurred or not in the case of using a fiber as a material to be plated in the composition for catalyst-free electroless plating in plating by the method for catalyst-free electroless plating, catalyst-free electroless plating was performed by using the fiber as the material to be plated in the composition for catalyst-free electroless plating.

The composition for electroless plating prepared in the same manner as in Example 1 was added into the aqueous fiber dispersion solution at a rate of 2 ml/min for 10 minutes. The concentration of the metal precursor added to the fiber solution was 0.003M at the beginning of adding the composition for the electroless plating. The remaining composition for electroless plating was then added to the aqueous fiber dispersion solution at once.

At this time, the pH of the composition for catalyst-free electroless plating was 9.5 and the temperature was 85° C. The reaction was continued for a total of 30 minutes from the time of adding the composition for electroless plating, and the plated fiber was obtained through filtering.

Figure 14:
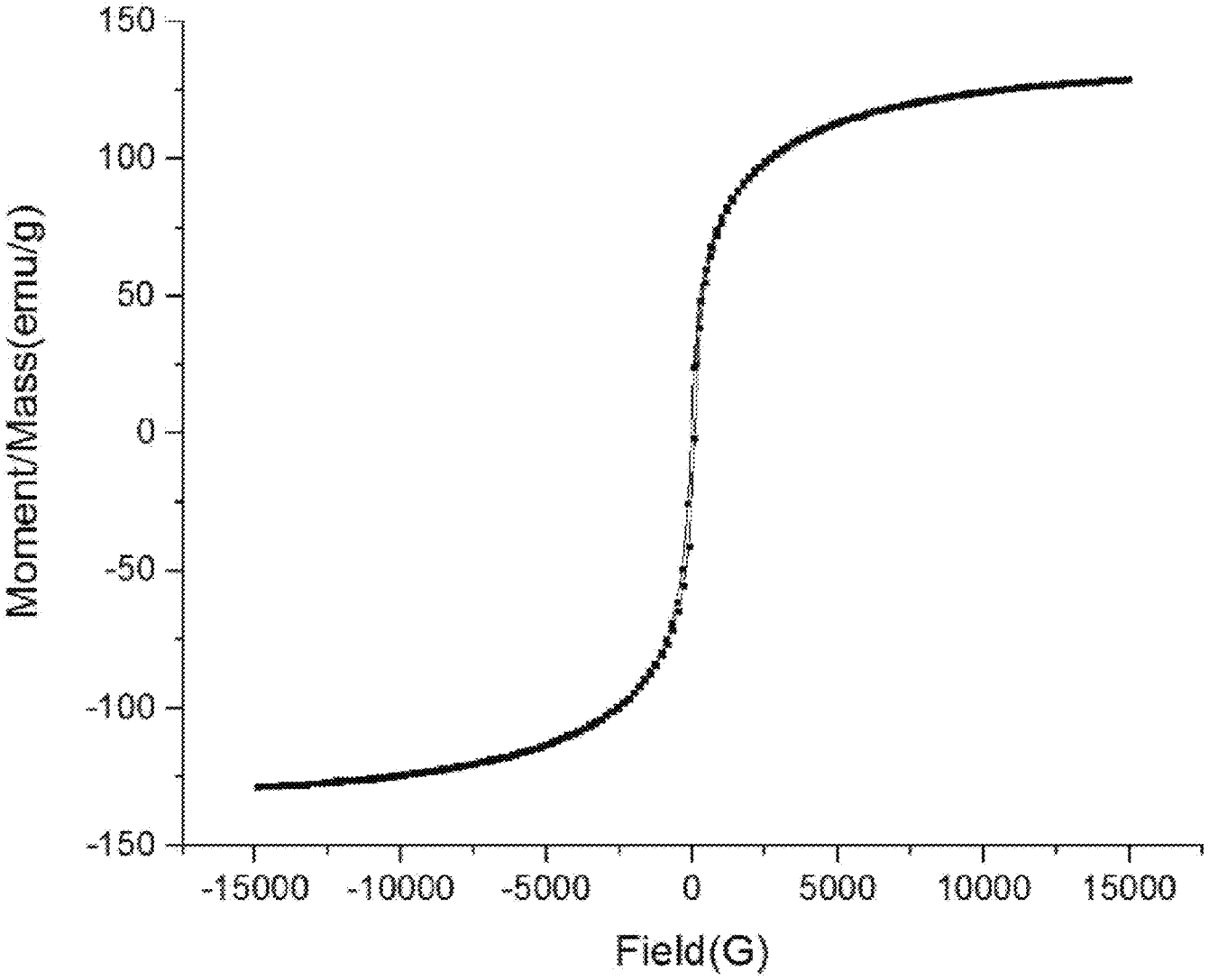
FIG. 14 is a graph illustrating saturation magnetization values of a fiber-magnetic particle composite when the fiber is used as a material to be plated in a composition for catalyst-free electroless plating during plating by an example of a method for catalyst-free electroless plating.
Figure 15:
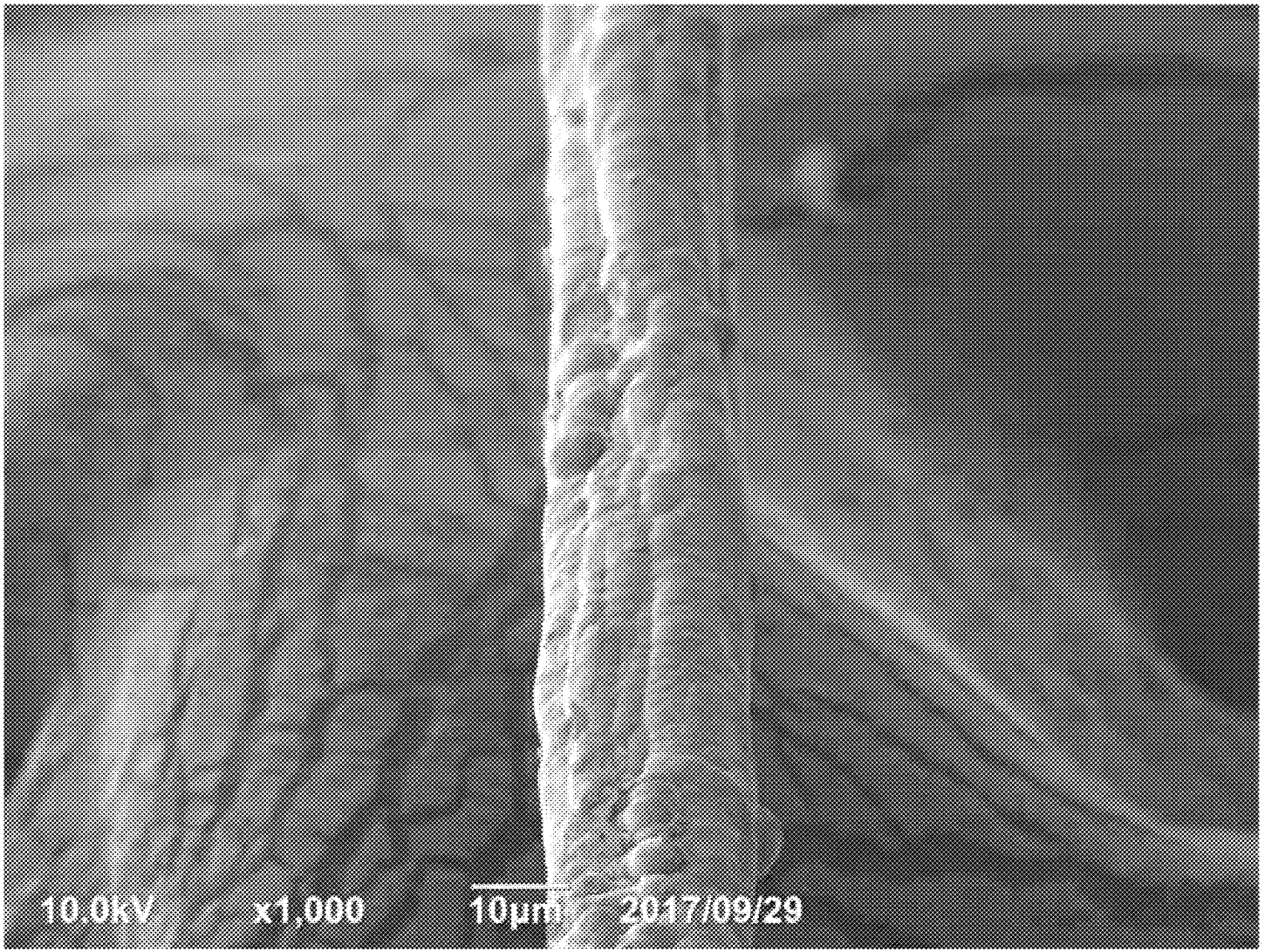
FIG. 15 is a SEM image illustrating that magnetic particles are well plated on a fiber after plating, wherein the fiber is used as a material to be plated in a composition for catalyst-free electroless plating during plating by an example of a method for catalyst-free electroless plating.

The saturation magnetization value of the obtained fiber-magnetic particle composite was measured and shown in FIG. 14. FIG. 14 is a graph illustrating saturation magnetization value of the fiber-magnetic particle composite when the fiber is used as the material to be plated in the composition for catalyst-free electroless plating in plating by the method for catalyst-free electroless plating. FIG. 15 is a SEM image illustrating that magnetic particles are well coated on the fiber after plating, wherein the fiber is used as an the material to be plated in the composition for catalyst-free electroless plating in plating by the method for catalyst-free electroless plating.

As shown in FIG. 14 and FIG. 15, it was confirmed that as a result of the catalyst-free electroless plating according to Example 30, the saturation magnetization value of the fiber-magnetic particle composite was 128.5 emu/g and the magnetic fiber was well formed due to excellent plating without using any catalyst.

Example 31-Example 33: Characteristics of a Material Plated by the Method for Catalyst-Free Electroless Plating when a Nickel Precursor is Used as the Metal Precursor and the Fiber Material is Used as the Material to be Plated in the Composition for Catalyst-Free Electroless Plating In order to investigate characteristics of a material plated by the method for catalyst-free electroless plating when a nickel precursor is used as the metal precursor and the fiber material is used as the material to be plated in the composition for catalyst-free electroless plating, catalyst-free electroless plating was performed by replacing an iron precursor, a cobalt precursor, and a nickel precursor with a nickel precursor in the composition for catalyst-free electroless plating.

Particularly, 0.2 g each of the PVA fiber (Example 31), Aramid (Example 32) and Vectran (Example 33) as the material to be plated were dispersed in 50 ml of water, and the pH was adjusted to 9.5 with sodium hydroxide. The result solution was heated to a temperature of 85° C. to provide each aqueous fiber solution.

Next, a composition for electroless plating at pH of 9.5 and temperature of 85° C. containing a metal precursor, a reducing agent, a complexing agent and a buffer with the compositions shown in the following Table 1 was prepared, wherein the iron precursor, the cobalt precursor, and the nickel precursor were replaced with the nickel precursor.

The prepared composition for electroless plating was added to the aqueous fiber dispersion solution at a rate of 2 ml/min for 10 minutes so that the concentration of the metal precursor added to the fiber solution was kept to be 0.003M at the beginning of adding the composition for electroless plating.

The remaining composition for electroless plating was then added at once to the aqueous fiber dispersion solution.

The reaction was continued for a total of 30 minutes from the time of introducing the composition for electroless plating and the plated fiber was then obtained through filtering.

Figure 16:
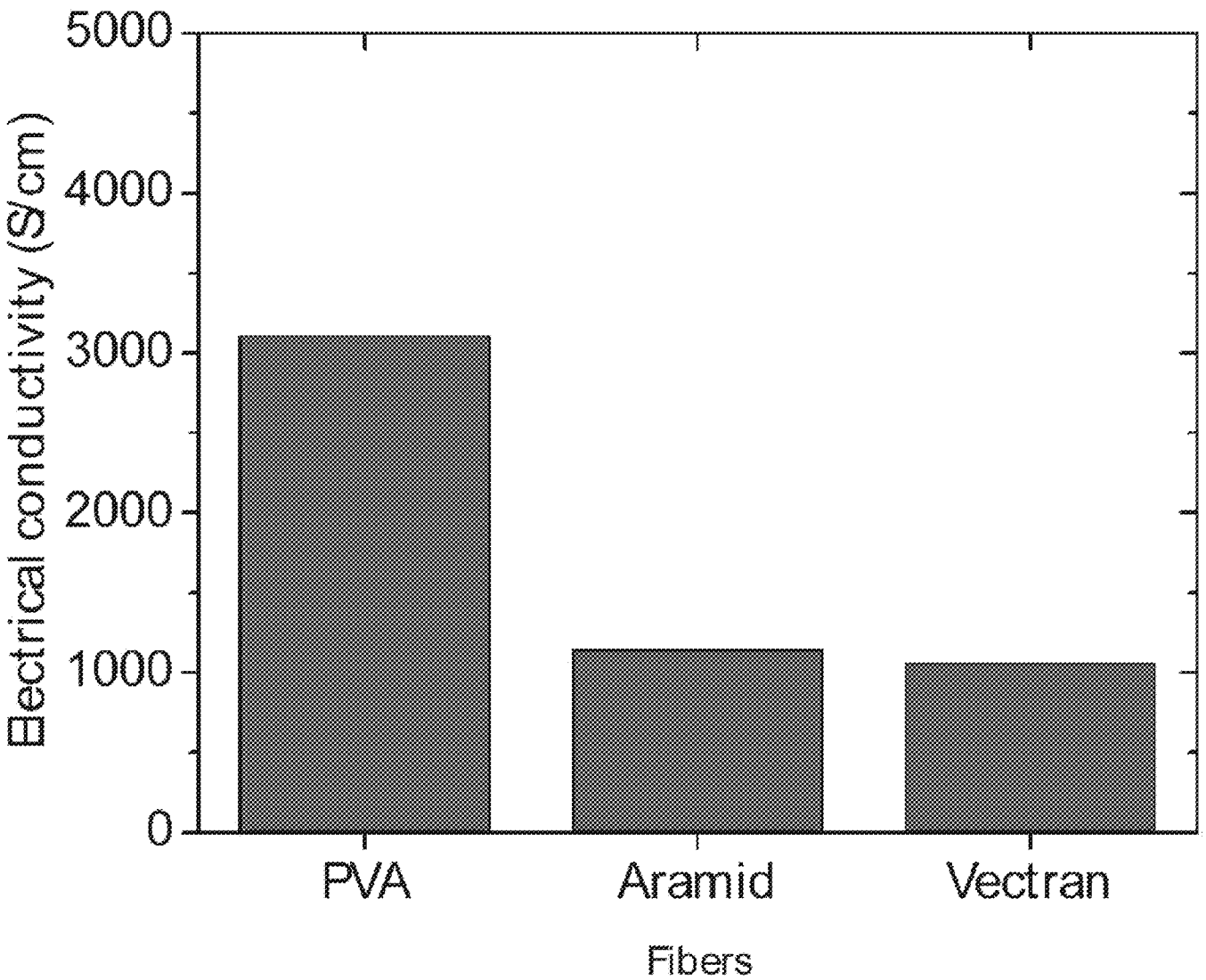
FIG. 16 is a graph illustrating electrical conductivity of a fiber-magnetic particle composite after plating, wherein a nickel precursor alone is used as a metal precursor and the fiber is used as a material to be plated in a composition for catalyst-free electroless plating during plating by an example of a method for catalyst-free electroless plating.
Figure 17:
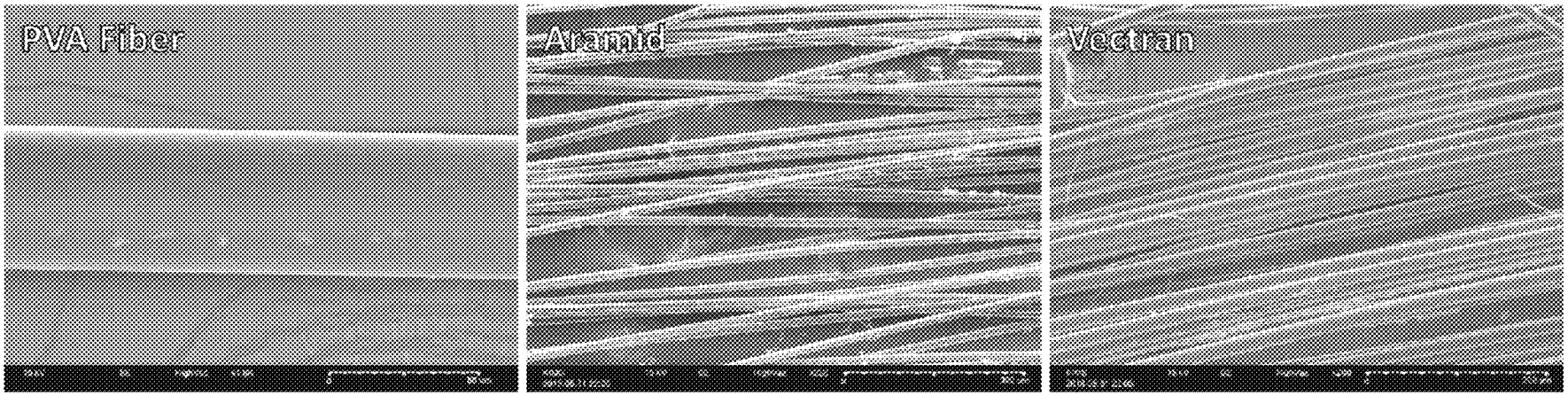
FIG. 17 is SEM images illustrating that magnetic particles are well plated on a fiber after plating, wherein a nickel precursor alone is used as a metal precursor and the fiber is used as a material to be plated in a composition for catalyst-free electroless plating during plating by an example of a method for catalyst-free electroless plating.

The characteristics of the plated material were analyzed and shown in FIG. 16 and FIG. 17.

FIG. 16 a graph illustrating electrical conductivity of the fiber-magnetic particle composite after plating, wherein the nickel precursor alone is used as the metal precursor and the fiber is used as the material to be plated in a composition for catalyst-free electroless plating in plating by a method for catalyst-free electroless plating. As shown in FIG. 16, as a result of the catalyst-free electroless plating according to Example 31 to Example 33, it was confirmed that the fiber-magnetic particle composites exhibited excellent electrical conductivity of 1000 S/cm or more.

FIG. 17 is SEM images illustrating that magnetic particles are well coated on the fiber after plating, wherein the nickel precursor alone is used as the metal precursor and the fiber is used as the material to be plated in a composition for catalyst-free electroless plating in plating by the method for catalyst-free electroless plating. As shown in FIG. 17, as a result of the catalyst-free electroless plating according to Example 31 to Example 33, it was confirmed that the nickel was clearly and well coated on the fibers.

Therefore, according to one embodiment of this disclosure, since a catalyst is not required, electroless plating can be performed in a single step without any catalyst pretreatment.

In addition, according to an embodiment of this disclosure, a catalyst such as an expensive noble metal catalyst is not required, and a manufacturing cost for the electroless plating can be reduced by simplifying the process.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

DESCRIPTION OF REFERENCE NUMERALS

10: Composition for catalyst-free electroless plating
20: Aqueous graphene dispersion solution
30: Graphene

What is claimed is:

1. A method for catalyst-free electroless plating using a first composition for catalyst-free electroless plating, the method comprising:

i) preparing a second composition for electroless plating, the second composition including a metal precursor and a reducing agent and not including a dispersion solution that contains a material to be plated; and ii) introducing the second composition for electroless plating into the dispersion solution containing the material to be plated to form the first composition for catalyst-free electroless plating that includes the metal precursor comprising a nickel precursor, the reducing agent, the material to be plated, and the dispersion solution, wherein a concentration of the metal precursor is 0.0001 to 0.0054 M in the first composition for catalyst-free electroless plating.

2. The method of claim 1, further comprising:

controlling pH of the first composition for electroless plating to at least 6.5.

3. The method of claim 1, wherein further comprising:

heating the first composition for catalyst-free electroless plating to 75° C. or higher.

4. The method of claim 1, wherein the introducing is maintained for at least one minute to promote nuclear growth.

5. The method of claim 1, wherein the introducing further comprises controlling pH of the dispersion solution containing the material to be plated to at least 6.5.

6. The method of claim 1, wherein the nickel precursor is at least one selected from nickel acetate, nickel sulfate ($NiSO_4$), nickel chloride($NiCl_2$), nickel carbonate($NiCO_3$), nickel nitrate($Ni(NO_3)_2$), and a hydrate thereof.

7. The method of claim 1, wherein the metal precursor further comprises at least one selected from an iron precursor, a cobalt precursor, a copper precursor, a molybdenum precursor, a tungsten precursor, and a zinc precursor.

8. The method of claim 1, wherein nickel of the nickel precursor in the first composition for catalyst-free electroless plating is included at an atomic ratio of 2% or more with respect to an entirety of the metal precursor.

9. The method of claim 1, wherein the reducing agent comprises at least one selected from dimethylamine borane (DMAB), hydrazine, sodium hypophosphite, sodium borohydride, and formaldehyde.

10. The method of claim 1, wherein the material to be plated is one selected from graphene, carbon nanotube, carbon black, carbon fiber, glass fiber, polymer fiber, and porous carbon material.

11. The method of claim 1, further comprising:

iii) additionally introducing the second composition for electroless plating into the dispersion solution containing the material to be plated after a metal nucleation using the first composition for catalyst-free electroless plating formed in the introducing has been completed.

* * * * *